US006347980B1

(12) United States Patent
Kamamura et al.

(10) Patent No.: US 6,347,980 B1
(45) Date of Patent: Feb. 19, 2002

(54) METHOD FOR GRINDING TRACTION SURFACE OF HALF-TOROIDAL-TYPE CONTINUOUSLY VARIABLE TRANSMISSION DISK

(75) Inventors: Yuukou Kamamura; Hiroyuki Ikeda; Masami Tanaka, all of Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 09/444,379

(22) Filed: Nov. 22, 1999

(30) Foreign Application Priority Data

Jan. 20, 1999 (JP) ..... 11-011676

(51) Int. Cl.[7] ..... B24B 1/00

(52) U.S. Cl. ..... 451/47; 451/161

(58) Field of Search ..... 451/47, 48, 177, 451/178, 119, 158, 159, 160, 161

(56) References Cited

FOREIGN PATENT DOCUMENTS

JP 11-226870 8/1999 ..... B24B/47/20

*Primary Examiner*—Derris H. Banks
(74) *Attorney, Agent, or Firm*—Sughrue Mion, PLLC

(57) ABSTRACT

In a method for grinding a traction surface of a half-toroidal CVT disk, there is provided a grinding machine including a hold mechanism holding the half-toroidal CVT disk having a given machining allowance, and a machining mechanism including a tool for grinding the half-toroidal CVT disk. The grinding of said grinding machine is performed in a state that one of the half-toroidal CVT disk and said tool is inclined at a predetermined angle with respect to the other. A cutting angle, which is an angle to be formed by the cutting direction of said tool with respect to the axis of the half-toroidal CVT disk, is set to be in the range of ±15° with respect to the angle that a first cutting magnification at the time of that said tool contacts with an outer periphery position of the traction surface is substantially equal to a second cutting magnification at the time that said tool contacts with an inner periphery position of the traction surface, each of said first and second cutting magnifications being a ratio of an apparent machining allowance to the given machining allowance.

10 Claims, 14 Drawing Sheets

GRINDSTONE INTERFERENCE DIAMETER & CUTTING MAGNIFICATION

METHOD FOR GRINDING TRACTION SURFACE OF HALF-TOROIDAL-TYPE CONTINUOUSLY VARIABLE TRANSMISSION DISK

BACKGROUND OF THE INVENTION

1. Field of the Invention

The present invention relates to a method for grinding the traction surface of a continuously variable transmission (CVT) disk of a half-toroidal type.

2. Description of the Related Art

Recently, the traction surface of a half-toroidal CVT disk used as a continuously variable transmission of a car has been worked or ground by a grinding machine.

The grinding machine used for such grinding operation includes a cylindrical grinding disk of a plane type and a grinding machine of an angular type. In the plane type grinding machine, a swing angle $\theta_1$ is set at 90° and, in the angular type grinding machine, a swing angle $\theta_1$ is set at 60°; and, a grindstone, which is mounted on the rotary shaft of the grinding machine, is slidably disposed in such a manner that it can cut in a direction perpendicular to the rotary shaft of the grindstone ($\theta_1$=90°) or at an angle ($\theta_1$=60°).

In the grinding machine, a work to be ground is held on an XY table. The XY table has not only the function of an X table to slide the work in an X direction but also the function of a Y table to slide the work in a Y direction. The X direction is the sliding direction of the work in the diameter direction thereof, whereas the Y direction is the sliding direction of the work in the rotation axis direction thereof.

In order to be able to carry out both of the X-table and Y-table functions with respect to the upper surface of the XY table, two structural elements required to fulfill their respective functions are piled up in two layers, and they are respectively superimposed on a spindle on the XY table side.

Also, referring further to a table for holding a work as other structural element than the XY table, there has been applied by the present applicants, a grinding machine comprising a swing table which can be slided in a direction perpendicular to the cutting direction of a grindstone (Japanese Patent Unexamined Publication No. 11-226870 of Heisei).

By the way, in the above-mentioned conventional grinding machines, there is found a problem that an actual machining allowance and an apparent machining allowance are different from each other. Also, there is raised another problem as to a grindstone interference diameter. That is, as shown in FIGS. 2A and 2B, when a grindstone 26 is outside butted against the grinding surface (that is, the surface to be ground) of a work 28, if the actual machining allowance is expressed by t, then the following relationships hold between the actual machining allowance t and apparent machining allowance t' (that is, a dimension over which the grindstone 26 advances from the outside of the machining allowance to a traction surface when it is completed):

$$t=t'\times\cos(\theta_1+\omega\mathbf{1}) \qquad \text{Expression 1}$$

where, $\theta_1$: spindle swing angle (an angle formed between a direction extending along the cutting direction of the grindstone 26 and a direction extending in parallel to the mounting surface of the work 28), and $$\omega\mathbf{1}\text{: Arc }\sin((\phi-pcd)/(r-t)) \qquad \text{Expression 2.}$$

Here, pcd expresses a radius which extends from the center of a curved surface of the traction surface of the CVT disk when it is completed to the center of the work 28 (PCD expresses the diameter of pcd), $\phi$ expresses the outer peripheral radius of the work 28, and r expresses the radius of the curved surface of the traction surface of the CVT disk when it is completed.

Also, as shown in FIGS. 3A and 3B, when the grindstone 26 is inside butted against the grinding surface of the work, the following relationships hold between the actual machining allowance t and apparent machining allowance t':

$$t=t'\times\cos(\pi 2-\theta_1-\omega 2) \qquad \text{Expression 3,}$$

$$\omega\mathbf{2}\text{: Arc }\sin((h\mathbf{1}-h\mathbf{2})/(r-t)) \qquad \text{Expression 4.}$$

Here, h1 expresses a height which extends from the bottom surface of the work 28 to the center of the curved surface of the traction surface of the CVT disk when it is completed, and h2 expresses the dimension of the height of the work 28.

As can be seen from the above-mentioned expressions, in both cases in which the grindstone 26 is outside and inside butted against the grinding surface of the work 28, a cutting magnification t'/t provides a value larger than 1, which means that the apparent machining allowance is larger than the actual machining allowance and, therefore, there is raised a problem that the cutting time of the grindstone 26 is made long.

Also, as the swing angle is made larger, the grindstone interference diameter must be reduced accordingly. Otherwise, there is caused interference in the outer peripheral portion of the disk with respect to the grindstone and, therefore, the outer peripheral portion of the disk is ground not in a linear contact manner but the work 28 is ground in a surface butting manner, which results in the dull ground shape.

Accordingly, if the grinding operation of the work 28 is executed by the grindstone 26, then the outside dimension of the grindstone 26 becomes small with the grinding of the work 28. Thus, if the grindstone diameter that can be used is small, then a spindle, on which the grindstone 26 is mounted, must be rotated at a high speed in order to gain the grindstone peripheral speed. In this case, the diameter of the shaft of the spindle becomes finer or smaller according to the dimension of the small grindstone diameter, thereby causing the rigidity of the spindle shaft to lower. Therefore, if the grindstone 26 is rotated at a high speed in order to enhance the grinding or working efficiency, then there is raised a fear that the rigidity of the spindle shaft can be made insecure. This problem will a rise not only in a case in which the grindstone diameter is reduced as it is used but also in a case in which the diameter of the grindstone 26 is previously set small.

Also, in a case in which the diameter of the grindstone 26 is previously set small, the usable range of the grindstone 26 is small and, therefore, the frequency of replacement of the grindstone 26 increases. This requires more time for replacement of the grindstone 26, which reduces the operating time of the grinding machine. Thus, the productivity of the work 28 cannot be enhanced, which is a disadvantage in the working or grinding cycle.

Further, if the grindstone diameter used is small, the number of abrasive grains of the grindstone surface actually used in the working or grinding operation is small. This reduces an interval in which the clogged grindstone is dressed, which also provides a disadvantage in the working or grinding cycle.

In addition, in a case in which a grindstone diameter used is equal to or less than a given value, it is difficult to structure a grinding machine. That is, a bracket for embracing the spindle and a grindstone base for carrying the bracket thereon must have mass and size equal to and larger than a given value regardless of the grindstone diameter and, therefore, it is difficult to structure a grinding machine in which only the grindstone diameter is small.

SUMMARY OF THE INVENTION

The present invention aims at eliminating the drawbacks found in the above-mentioned conventional method for grinding the traction surface of a half-toroidal CVT disk. Accordingly, it is an object of the invention to provide a method for grinding the traction surface of a half-toroidal-type CVT disk in which the disk can be ground or worked within the proper range of spindle swing angles and the diameter of a grindstone is set equal to or larger than a given value.

In attaining the above object, according to the first aspect of the invention, there is provided a method for grinding a traction surface of a half-toroidal CVT disk, including the steps of:

preparing a grinding machine including a hold mechanism holding the half-toroidal CVT disk having a given machining allowance; and a machining mechanism including a tool for grinding the half-toroidal CVT disk, the grinding of the grinding machine being performed in a state that one of the half-toroidal CVT disk and the tool is inclined at a predetermined angle with respect to the other; and setting a cutting angle, which is an angle to be formed by the cutting direction of the tool with respect to the axis of the half-toroidal CVT disk, in the range of ±15° with respect to the angle that a first cutting magnification at the time of that the tool contacts with an outer periphery position of the traction surface is substantially equal to a second cutting magnification at the time that the tool contacts with an inner periphery position of the traction surface, each of the first and second cutting magnifications being a ratio of an apparent machining allowance to the given machining allowance.

With the first aspect of the invention, since the cutting angle of the tool is set in the range of ±15° with respect to the angle that makes the cutting magnification smallest, the apparent cutting magnification does not become so large but can be controlled down into a small range. Thus, this makes it possible to shorten the grinding operation time.

According to the second aspect of the invention, there is provided a method for grinding a traction surface of a half-toroidal CVT disk, including the steps of:

preparing a grinding machine including a hold mechanism holding the half-toroidal CVT disk having a given machining allowance; and a machining mechanism including a tool for grinding the half-toroidal CVT disk, the grinding of the grinding machine being performed in a state that one of the half-toroidal CVT disk and the tool is inclined at a predetermined angle with respect to the other; and setting a swing angle, which is an angle to be formed by the rotation axis of the tool with respect to a surface perpendicular to the axis of the half-toroidal CVT disk so that an angle difference between a cutting angle, which is an angle to be formed by the cutting direction of the tool with respect to the axis of the half-toroidal CVT disk, and the swing angle is 15° or less.

With the second aspect of the invention, because angle differences between the swing and cutting angles of the tool can be set individually at 15° or less, it is possible to select the swing angle of the tool that can made the grindstone interference diameter large. And, since the above angle differences are equal to or less than 15°, a load to be applied to the tool in the thrust direction thereof can be prevented from being large, which can prevent an inconvenience that a thrust load can be applied to the tool to thereby break the tool or worsen the grinding accuracy of the tool.

In this case, if the cutting and swing angles are set properly, compatibility between the cutting magnification and tool diameter can be secured. Due to this, the work grinding performance of the tool can be enhanced comprehensively.

According to the third aspect of the invention, there is provided a method for grinding a traction surface of a half-toroidal CVT disk, comprising the steps of:

preparing a grinding machine including a hold mechanism holding the half-toroidal CVT disk having a given machining allowance; and a machining mechanism including a tool for grinding the half-toroidal CVT disk, the grinding of the grinding machine being performed in a state that one of the half-toroidal CVT disk and the tool is inclined at a predetermined angle with respect to the other;

determining the maximum diameter of the tool in the range of 0.9 times to 0.5 times an interference grindstone diameter, the interference grindstone diameter being calculated from a dimension between the center of curvature of a curved surface of the traction surface of the half-toroidal CVT disk and the rotation center of the half-toroidal CVT disk, the dimension of the radius of curvature of the traction surface, the dimension of the outer peripheral diameter of the traction surface, and a swing angle, which is an angle to be formed by the rotation axis of the tool with respect to a surface perpendicular to the axis of the half-toroidal CVT disk; and setting the swing angle so that an angle difference between a cutting angle, which is an angle to be formed by the cutting direction of the tool with respect to the axis of the half-toroidal CVT disk, and the swing angle is 15° or less.

With the third aspect of the invention, because the interference diameter of the tool is obtained from the swing angle and the dimension of the work and the diameter of the tool is set in the range of 0.9 times to 0.5 times the grindstone interference diameter, the diameter of the tool to be used actually can be made largest in its allowable range. This makes it possible to shorten the grinding operation time, and provides a proper grinding which improves the efficiency of the grinding operation and the accuracy thereof. Also, the grinding operation can be carried out in such a manner that there are removed factors causing the poor surface quality such as the dull generator shape, re-grinding and the like.

Also, since a sufficient usable range of the tool can be secured, it is possible to reduce the frequencies of dressing and replacement of the tool. This can increase the time ratio of the actual grinding operation to the general grinding operation, so that the grinding performance of the grinding machine can be enhanced.

The present disclosure relates to the subject matter contained in Japanese patent applications No. Hei.10-122294 filed on May 1, 1998 and No. Hei. 11-011676 filed on Jan. 20, 1999 which are expressly incorporated herein by reference in its entirety.

BRIEF DESCRIPTION OF THE DRAWINGS

FIG. 2A is an imaginary view of a state in which the grindstone and half-toroidal CVT disk are outside butted with each other, and FIG. 2B is an enlarged view of the outside butted portions of the grindstone and half-toroidal CVT disk;

FIG. 3A is an imaginary view of a state in which the grindstone and half-toroidal CVT disk are inside butted with each other, and FIG. 3B is an enlarged view of the inside butted portions of the grindstone and half-toroidal CVT disk;

FIG. 4A is a general view, showing a state in which the grindstone and a half-toroidal CVT disk are in contact with each other at the position D, and FIG. 4B is an enlarged view of the neighboring portion of the position D;

FIG. 5A is a view of the dimensional relationships of the neighboring portion of the position D in a plan view of the grindstone, and FIG. 5B is a view of the contact state of the grindstone at the position D;

DETAILED DESCRIPTION OF THE PREFERRED EMBODIMENTS

Now, a description will be given below of an embodiment of a method for grinding the traction surface of a half-toroidal CVT disk according to the invention with reference to FIGS. 1 through 7.

Figure 7:
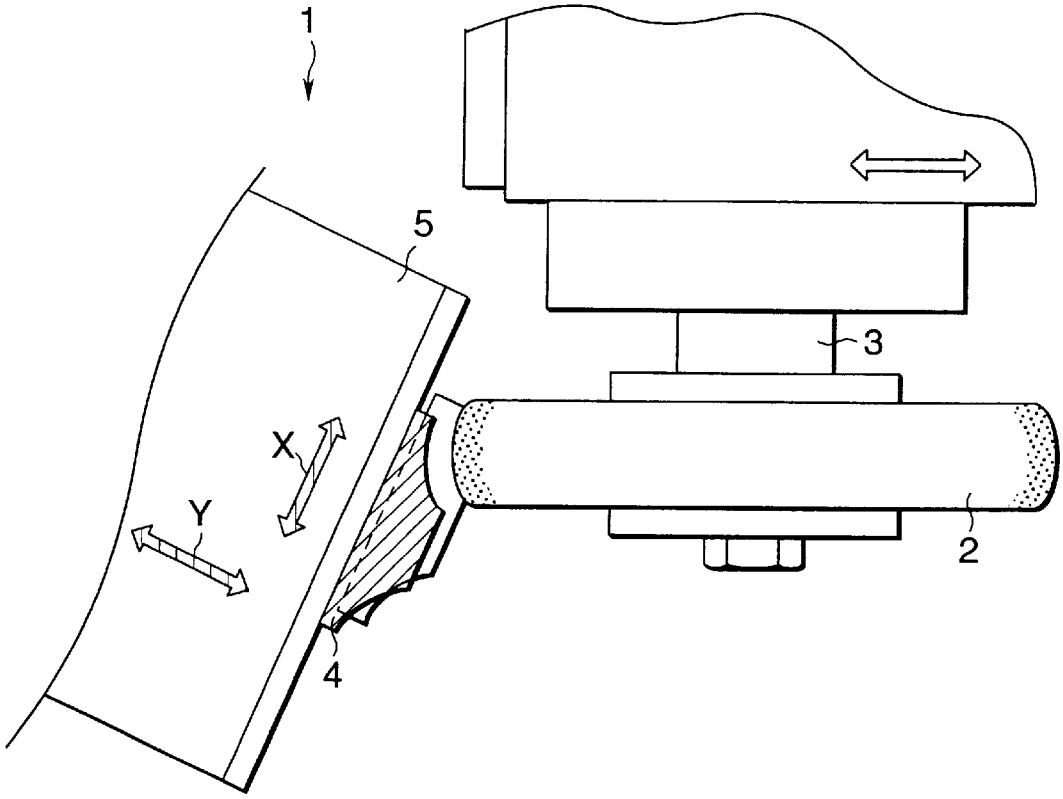
FIG. 7 is a side view of the structure of a grinding machine according to an embodiment of the invention.

By the way, FIG. 7 shows a grinding machine in which a swing angle $\theta_1$ (set equal to cutting angle $\theta_2$ described later in detail) is set at a given angle $\theta_1$ (that is, $\theta_1$: in the range of 15–40°).

Figure 1:
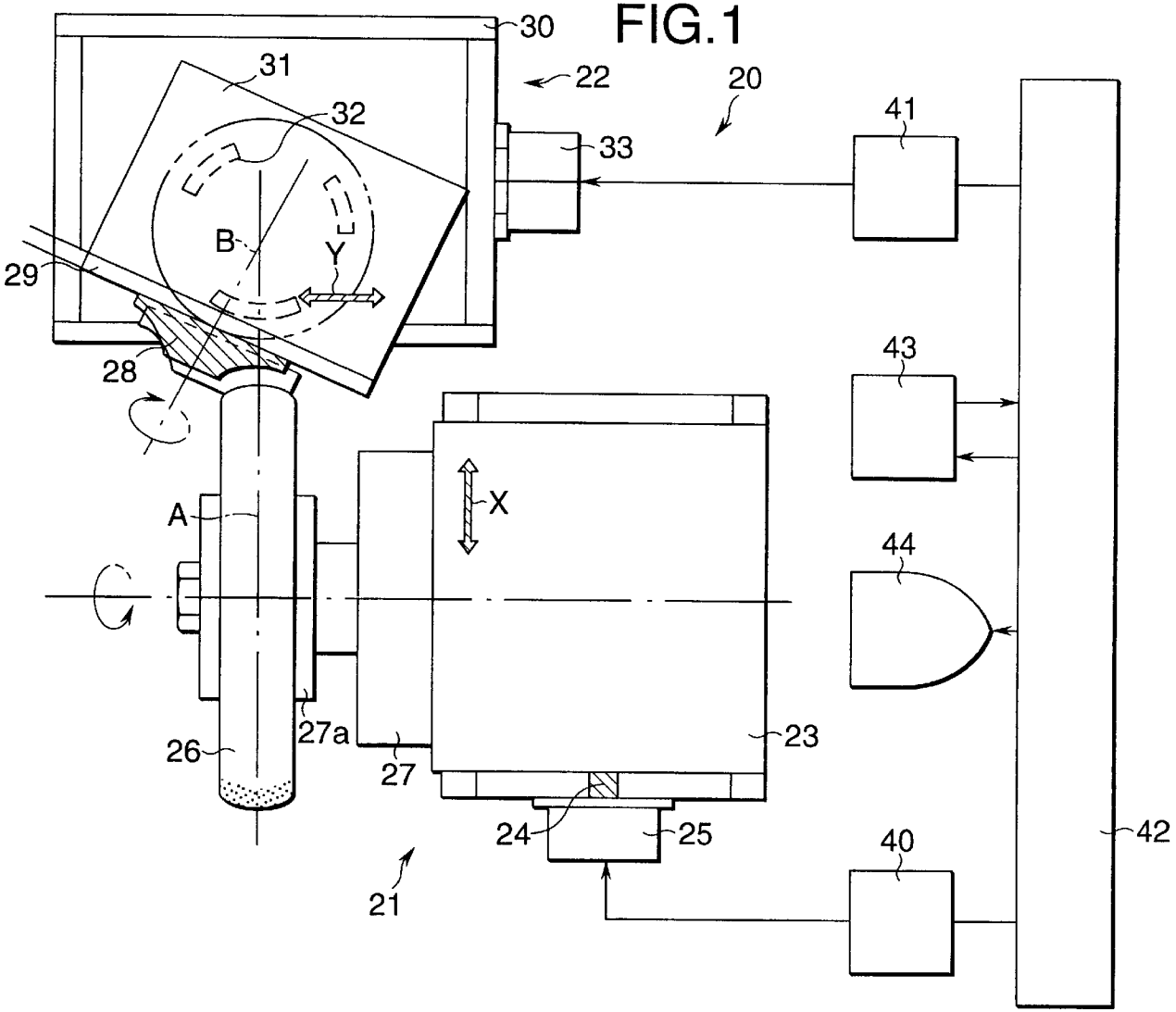
FIG. 1 is a side view of the structure of a grinding machine according to a first embodiment of the invention.
Figure 2A:
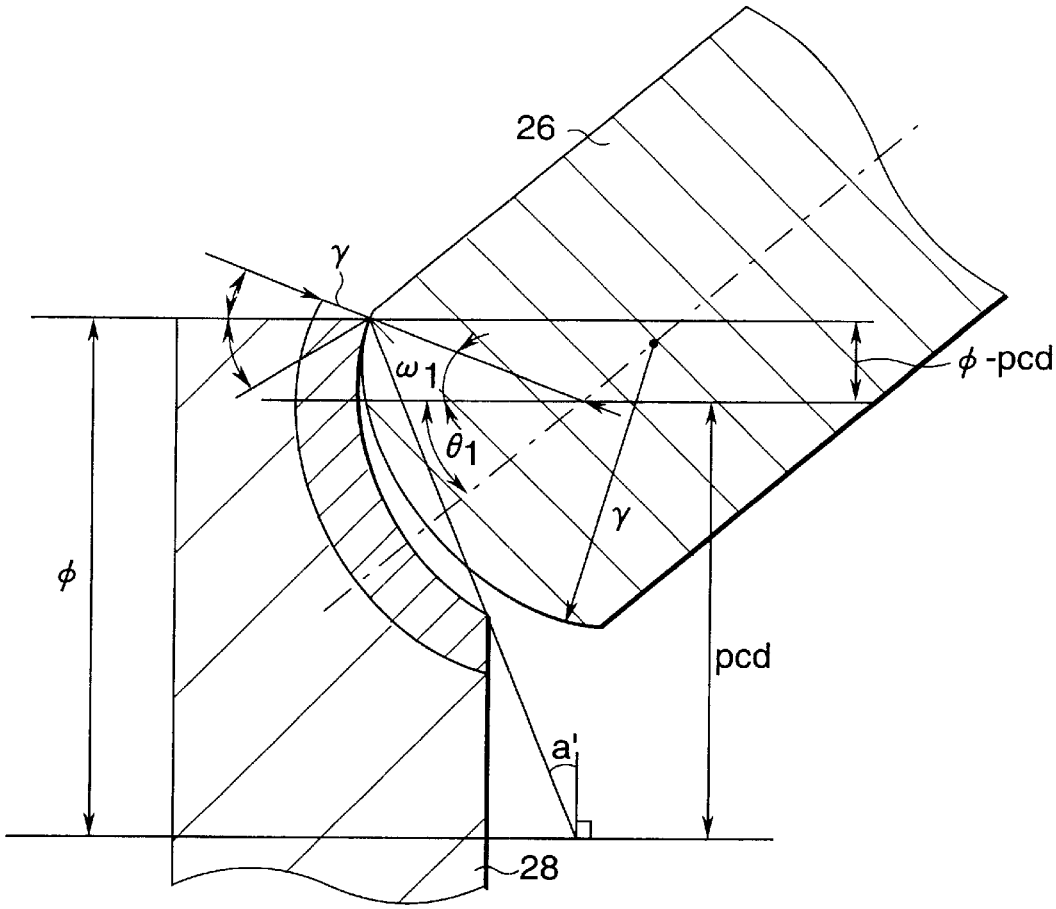
FIGS. 2A and 2B show a state in which a grindstone and a half-toroidal CVT disk according to the first embodiment are outside butted with each other; in particular.
Figure 2B:
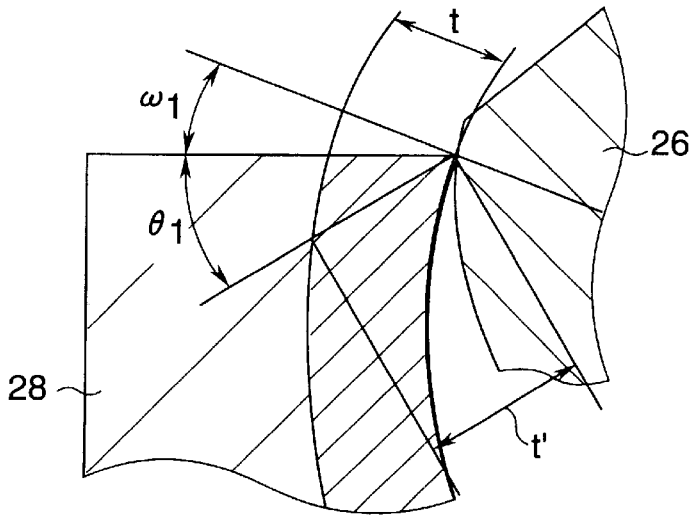
Figure 3A:
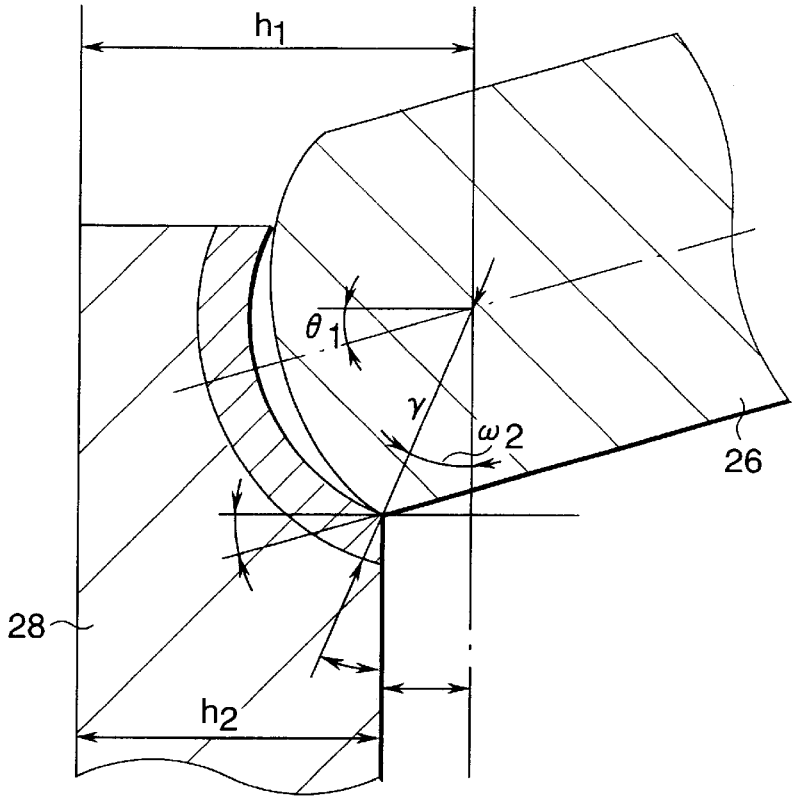
FIGS. 3A and 3B show a state in which a grindstone and a half-toroidal CVT disk according to the first embodiment are inside butted with each other; in particular.
Figure 3B:
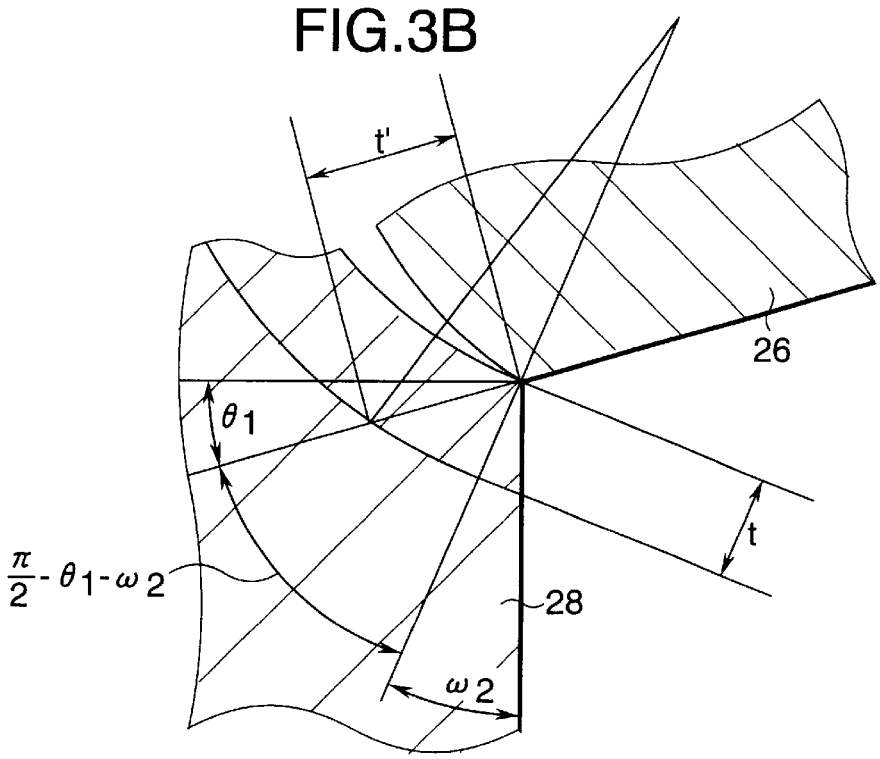

Specifically, a grinding machine 20 shown in FIG. 1 includes a grinding mechanism (machining mechanism) 21 and a drive mechanism (hold mechanism) 22. The grinding mechanism 21 includes a cutting table 23, while the cutting table 23 is structured such that it can be operated in linking with a servo motor 25 serving as first drive means through a ball screw 24. The servo motor 25 is disposed at a fixed position.

Accordingly, if the servo motor 25 is driven and rotated, then the cutting table 23 is driven in the vertical direction (which is hereinafter referred to as the X direction).

In the inside of the cutting table 23, there is included a drive motor (not shown) which is used to drive and rotate a grindstone (tool) 26; that is, a drive force, which is generated by the drive motor, is transmitted through a grindstone spindle 27 to the grindstone 26 to thereby drive and rotate the same. By the way, in the leading end of the grindstone spindle 27, there is disposed a tool hold base 27*a* which is used to hold the grindstone 26.

The grindstone 26 is formed in a curved shape having a radius which corresponds to the traction surface of a half-toroidal CVT disk 28 (which is hereinafter referred to as a work 28) in which the grinding operation of the outer periphery side grinding surface thereof is ended to thereby produce a completed product or a completed disk. Therefore, since there is present a machining allowance in the work 28 before it is ground, the radius of the surface to be ground of the work 28 is formed smaller than the diameter of the outer periphery side grinding surface of the grindstone 26.

Here, it is necessary that the work 28 to be ground is fixed by chucking to a cross slide 29 and the work 28 is thereafter moved as it is ground. To carry out this operation, there is provided the drive mechanism 22. The drive mechanism 22 includes a base 30 which serves as a work spindle table, while the base 30 includes a swing table 31. Thanks to this structure, the inclination angle of the cross slide 29 on the swing table 31 can be adjusted with respect to the base 30.

Also, in the inside of the swing table 31, there is disposed a swing guide 32 which is used to carry out a regular swing operation. The swing guide 32 is formed, for example, in a groove shape and has a function to guide the driving and swinging of the swing table 31 to thereby restrict the inclination angle adjust operation of the swing table 31 with respect to the cutting axis of the grindstone 26.

By the way, in the inside of the swing table 31, there is disposed a work spindle (not shown) and thus the swing table 31 can be driven and rotated about its rotary shaft by the work spindle.

The work 28 fixed to the cross slide 29 is structured such that a rotation axis B thereof can be properly rotated and set at a given angle with respect to the cutting axis A of the grindstone 26, and also, in order to allow the work 28 to correspond to the inclination of a rotation axis B, the work 28 is mounted in such a manner that the center axis thereof coincides with the rotation axis B.

The base 30 including the above-mentioned swing table 31 is connected to a servo motor 33 which serves as second drive means. The servo motor 33 is capable of driving the base 30 in a direction which intersects at right angles to the cutting rotary axis A and extends in parallel to the grindstone spindle 27 (which is hereinafter referred to as a Y direction).

The two servo motors 25 and 33 are respectively connected to their associated drive circuits 40 and 41, while the two drive circuits 40 and 41 are both connected to a numerical control unit 42. To the numerical control unit 42, for example, there are input master data on the shape of the work 28 after completed, the actual dimensions of the work 28 and the like; and, the numerical control unit 42 determines the amount of working or grinding of the work 28 in accordance with the thus inputted data values.

By the way, the two drive circuits 40, 41 and numerical control unit 42 cooperate together in forming position control and correct means.

Accordingly, in accordance with the working or grinding amount of the work 28 calculated in the numerical control unit 42, the numerical control unit 42 gives a control instruction to the two drive circuits 40 and 41 and, in response to this control instruction, the two drive circuits 40 and 41 respectively control currents which are respectively allowed to conduct in their associated servo motors 25 and 33 As a result of this, not only the movement of the cutting table 23 in the X direction but also the movement of the base 30 in the Y direction can be set at their respective desired positions.

Also, the numerical control unit 42 further comprises a key board 43 capable of inputting numerical values and a display CRT 44 which can be used to display positions in the X and Y directions.

Now, a description will be given below of a grinding method which can be executed using the grinding machine 20 having the above-mentioned structure.

At first, according to the expression 1 that has been set forth in the "Problems to be Solved by the Invention" section in the present specification, the apparent machining allowance t' is larger than the actual machining allowance t. Here, assuming that t'/t is a cutting magnification, a cutting magnification for the outside butting by the grindstone is 1, and a cutting magnification for the inside butting is 2, from FIGS. 2 and 3, there can be obtained the following expressions:

That is:

Cutting magnification 1: $t'/t=1/\cos(\theta_1+\omega 1)$ Expression 5

Cutting magnification 2: $t'/t=1/\cos(\pi 2-\theta_1-\omega 2)$ Expression 6.

In this case, the nearer to 1 the cutting magnifications 1 and 2 are, the more the apparent machining allowance t' approaches the actual machining allowance t. However, if either of the outside butting or inside butting occurs, because the grindstone 26 and work 28 are in contact with each other, the larger the cutting magnification is, the longer the time required for the grinding operation is.

Here, the interference diameter of the grindstone 26 varies depending on the swing angle $\theta_1$ of the grindstone 26. Now, a description will be given below of the relationship between the interference diameter and swing angle θ with reference to FIGS. 4 and 5. The grindstone interference diameter expresses the diameter, but the grindstone interference diameter is also explained by using a radius Rw being the half of the grindstone interference diameter.

At first, when a distance from the grindstone 26 section passing through a position D to the center of the grindstone 26 is expressed as Rc, the radius of the work 28 is expressed as ϕ, a distance from the center of the diameter of the work 28 to the center of the traction surface of the work 28 is expressed as pcd, and a depth situated by a distance c apart from the center of the traction surface is expressed as a, then there can be obtained the following expression: that is, $$a=(r^2-c^2)^{1/2}-(r^2-pcd)^2)^{1/2}$$ Expression 7

Figure 4A:
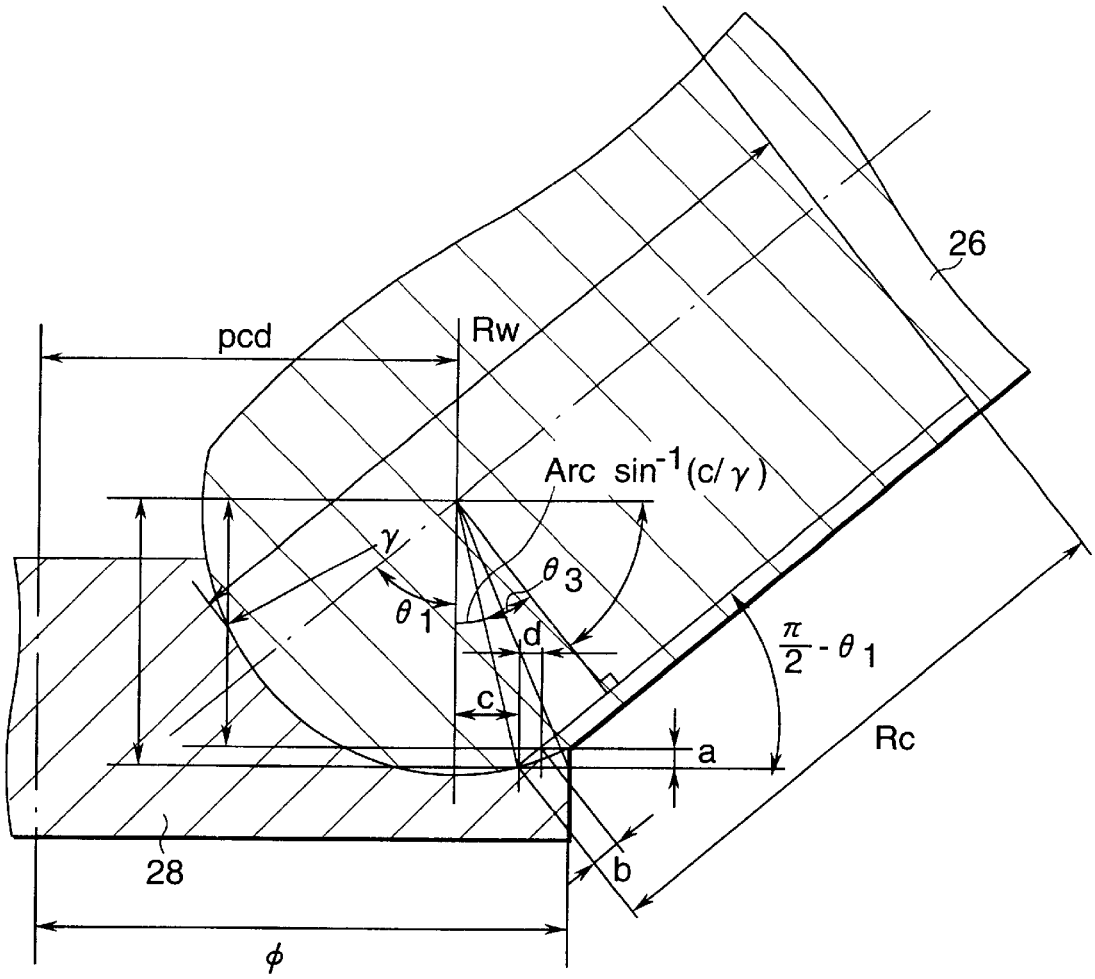
FIGS. 4A and 4B shows the dimensional relationships between a grindstone and a work according to the first embodiment which respectively pass through a position D; in particular.
Figure 4B:
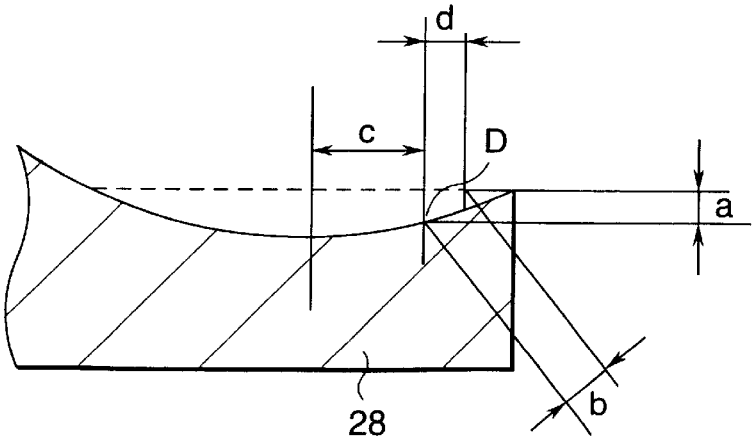

Also, in FIGS. 4 and 5, b and d can be expressed by the following expressions, respectively: that is, $$b=a/\sin(\pi 2-\theta_1)$$ Expression 8

$$d=b\cos(\pi 2-\theta_1)$$ Expression 9

Figure 5A:
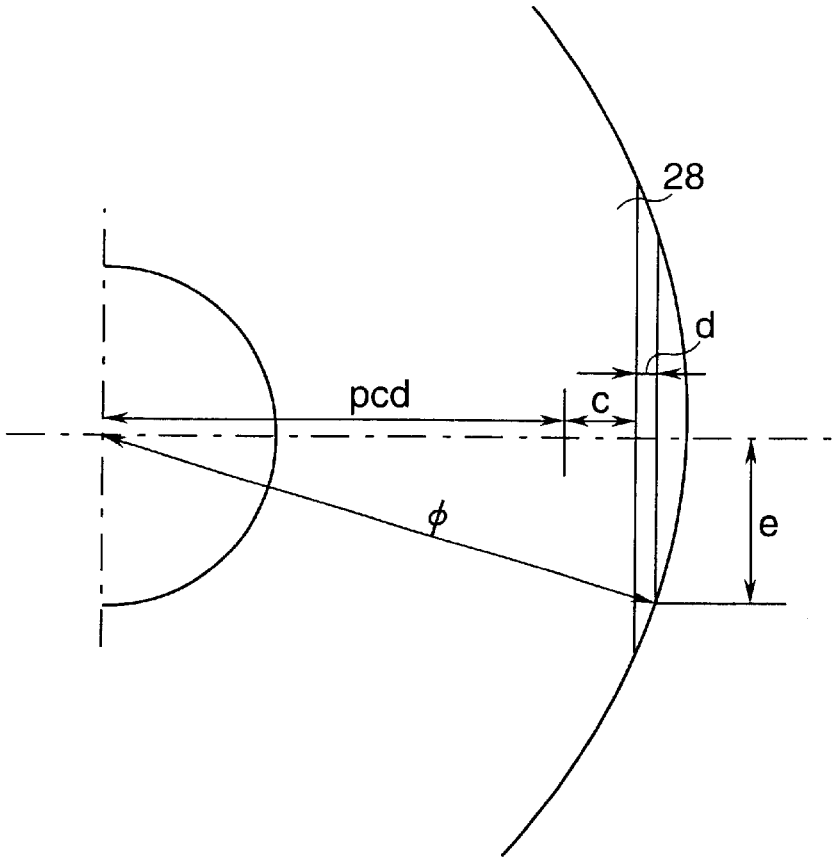
FIGS. 5A and 5B show the dimensional relationships between a grindstone and a work according to the first embodiment which respectively pass through a position D; in particular.

Here, in FIG. 5A, e can be expressed by the following expression: that is, $$e=(\phi^2-(pcd+c+d)^2)^{1/2}$$ Expression 10

Figure 5B:
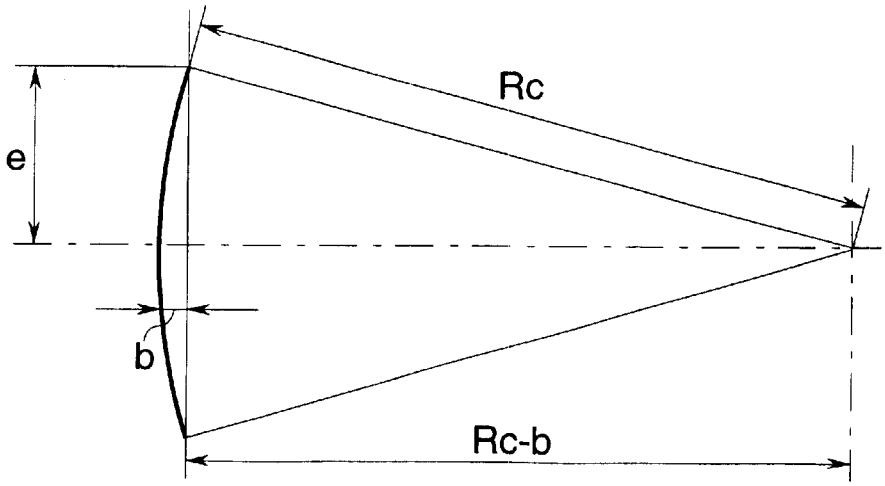

Further, in FIG. 5B, there can be obtained the following expression: that is, $$(Rc-b)^2+e^2=Rc^2$$ Expression 11

If the expression 11 is expanded, then there can be obtained the following expression: that is, $$Rc=(b^2+e^2)/2b$$ Expression 12

From this, there can be obtained the following expression: that is, $$Rc=\{b^2+(\phi^2+(pcd+c+d)^2)\}/2b$$ Expression 13

Also, there can be obtained the following numeric expression: that is, $$Rc'=lim(Rc)c\rightarrow(\phi-pcd)$$ [Numeric expression 1]

Thus, there can be obtained the following expression: that is, $$Rw=Rc'+r(1-\sin\theta_3)$$

$$=Rc'+r(1-\sin[\pi/2-\theta_1-\mathrm{Arc}\sin(c/r)])$$

$$=Rc'+r(1-\cos[\theta_1+\mathrm{Arc}\sin(c/r)])$$ Expression 14

According to the expression 14, it can be well the that as the swing angle $\theta_1$ increases, the value of Rw decreases. That is, if the swing angle $\theta_1$ is increased, then the apparent cutting amount increases and the grindstone interference diameter decreases, which raises a problem in the working or grinding operation.

Figure 6:
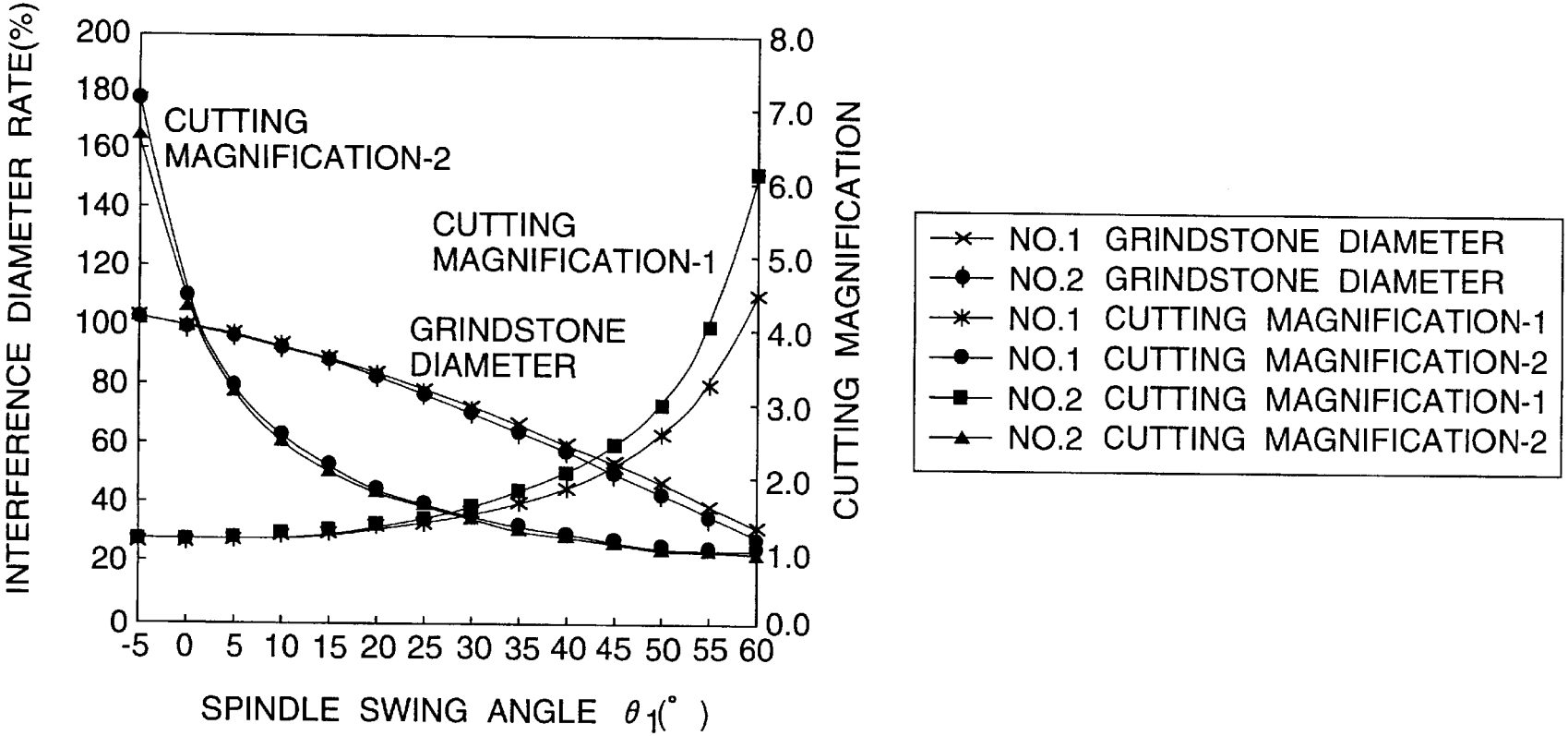
FIG. 6 is a graphical representation of the relationships among cutting magnifications 1, 2, grindstone interference diameter and spindle swing angle $\theta_1$ according to the present embodiment.

In view of this, in FIG. 6, there is shown the relationships among the cutting magnifications 1, 2, the grindstone interference diameter, and spindle swing angle $\theta_1$.

In FIG. 6, when the spindle swing angle $\theta_1$ is 0°, then the grindstone interference diameter is just 100%; and, generally, there can be found the relationship that, as the spindle swing angle $\theta_1$ increases, the grindstone interference diameter decreases.

Also, if the spindle swing angle $\theta_1$ increases from 0°, then there firstly occurs the inside butting between the work 28 and grindstone 26. In this case, the cutting magnification 2, when the inside butting occurs between work 28 and grindstone 26 at the spindle swing angle $\theta_1$ of −5°, takes the maximum value. As the spindle swing angle $\theta_1$ increases from this angle, the cutting magnification 2 decreases; and, when the spindle swing angle $\theta_1$ is 15°, the cutting magnification 2 is substantially 2. And, if the spindle swing angle $\theta_1$ increases further, then, when the spindle swing angle $\theta_1$ is 30°, there occur both of the inside and outside butting between the work 28 and grindstone 26. By the way, referring to the cutting magnification 1, as the spindle swing angle $\theta_1$ increases, the value of the cutting magnification 1 increases gradually.

After the two side butting occur, if the spindle swing angle $\theta_1$ further increases, then there occurs the outside butting between the work 28 and grindstone 26, thereby causing the cutting magnification 1 to increase. And, when the spindle swing angle $\theta_1$ is 40°, then the cutting magnification 1 is substantially 2; and, if the spindle swing angle $\theta_1$ increases from this angle, then the cutting magnification 1 increases. By the way, in this case, the cutting magnification 2 decreases and approaches 1 as the spindle swing angle $\theta_1$ increases.

Here, when both of the cutting magnifications 1 and 2 are small in value, the time required for the grinding operation is short; that is, from the viewpoint of enhancement of efficiency of the grinding operation, it is preferable to set the cutting magnifications 1 and 2 in the small values. However, as can be seen from FIG. 6, the cutting magnifications 1 and 2 have a correlative relationship between them; that is, if one of them increases, then the other decreases. Therefore, it is necessary to restrict the respective values of the cutting magnifications 1 and 2 to a given range of values. Specifically, when the spindle swing angle $\theta_1$ is in the range of 15°–40°, both of the cutting magnifications 1 and 2 provide values equal to or less than 2.13, which is preferred from the viewpoint of the efficiency of the grinding operation. If the spindle swing angle $\theta_1$ provides other values than this range of values, then either of the cutting magnifications 1 and 2 provides a larger value than 2, which increases the time required for grinding the work.

Also, if the spindle swing angle $\theta_1$ increases, then the grindstone interference diameter decreases: in particular, as can be seen from FIG. 6, for $\theta_1$=15°, the grindstone interference diameter is 85% of that when $\theta_1$=0°; and, for $\theta_1$=40°, the grindstone interference diameter is 60% of that when $\theta_1$=0°. However, if the spindle swing angle $\theta_1$ increases over 40°, then the grindstone interference diameter further decreases, thereby causing the above-mentioned problem to arise in the grinding operation.

For the above reasons, from the viewpoint of the cutting magnifications 1, 2 and grindstone interference diameter, preferably, the spindle swing angle $\theta_1$ may be set in the range of 15°–40°.

By the way, Tables 2 and 4 respectively show the experimental results of half-toroidal CVT disk test pieces No. 1 and No. 2 respectively shown in Tables 1 and 3, in particular, the relationships among the spindle swing angle $\theta_1$, grindstone interference diameters, and cutting magnifications 1, 2. The surface angle of Table 1 expresses an angle a' formed between a straight line connecting the outer and inner edges of the traction surface and a vertical line, which is perpendicular to the axis of the work and passes through an intersection point of the straight line with the axis of the work (See FIG. 2A).

TABLE 1

| Test Piece No. 1 | | | |
|---|---|---|---|
| Dimension of parts [mm] | Outer Diameter | ϕ × 2 | 153.0 |
| | PCD | pcd × 2 | 132.0 |
| | Groove R | r | 40.0 |
| | PC height | h1 | 53.0 |
| | Width | h2 | 45.0 |

TABLE 1-continued

| Test Piece No. 1 | | | |
|---|---|---|---|
| Traction surface [deg] | Outer edge angle | ω1 | 15.2 |
| | Inner edge angle | ω2 | 11.5 |
| | Surface angle | a' | 31.6 |

TABLE 2

| Spindle Swing Angle $\theta_1$ | Grindstone Interference Diameter ratio % | Cutting Magnifications 1 | Cutting Magnifications 2 |
|---|---|---|---|
| −5 | 102.0 | 1.02 | 7.18 |
| 0 | 100.0 | 1.05 | 4.44 |
| 5 | 97.4 | 1.08 | 3.24 |
| 10 | 94.1 | 1.13 | 2.56 |
| 15 | 90.3 | 1.19 | 2.13 |
| 20 | 85.9 | 1.26 | 1.84 |
| 25 | 81.0 | 1.36 | 1.62 |
| 30 | 75.5 | 1.48 | 1.47 |
| 35 | 69.7 | 1.64 | 1.35 |
| 40 | 63.4 | 1.86 | 1.25 |
| 45 | 56.7 | 2.16 | 1.18 |
| 50 | 49.8 | 2.61 | 1.12 |
| 55 | 42.5 | 3.32 | 1.08 |
| 60 | 35.1 | 4.60 | 1.05 |
| 65 | 27.6 | 7.62 | 1.02 |

TABLE 3

| Test Piece No. 2 | | | |
|---|---|---|---|
| Dimension of parts [mm] | Outer Diameter | ϕ × 2 | 151.1 |
| | PCD | pcd × 2 | 124.0 |
| | Groove R | r | 38.0 |
| | PC height | h1 | 48.9 |
| | Width | h2 | 40.0 |
| Traction surface [deg] | Outer edge angle | ω1 | 20.9 |
| | Inner edge angle | ω2 | 13.5 |
| | Surface angle | a' | 27.8 |

TABLE 4

| Spindle Swing Angle $\theta_1$ | Grindstone Interference Diameters ratio % | Cutting Magnifications 1 | Cutting Magnifications 2 |
|---|---|---|---|
| −5 | 102.4 | 1.04 | 6.73 |
| 0 | 100.0 | 1.07 | 4.27 |
| 5 | 97.0 | 1.11 | 3.14 |
| 10 | 93.4 | 1.17 | 2.50 |
| 15 | 89.2 | 1.23 | 2.09 |
| 20 | 84.5 | 1.32 | 1.81 |
| 25 | 79.3 | 1.44 | 1.60 |
| 30 | 73.7 | 1.59 | 1.45 |
| 35 | 67.6 | 1.78 | 1.33 |
| 40 | 61.2 | 2.06 | 1.24 |
| 45 | 54.4 | 2.45 | 1.17 |
| 50 | 47.4 | 3.05 | 1.12 |
| 55 | 40.1 | 4.10 | 1.07 |
| 60 | 32.7 | 6.32 | 1.04 |
| 65 | 25.2 | 13.95 | 1.02 |

According to a grinding method using the above-structured grinding machine 20, since the inclination angle of the grindstone 26 for the diameter direction thereof is set in the range of 15°–40° with respect to the axis of the work 28, the apparent machining allowance t' can be restricted to a value equal to or less than the double of the actual machining allowance t. Thanks to this, the working or grinding distance of the grindstone 26 can be controlled to a short range, thereby being able to shorten the working time that is necessary for the grindstone 26 to work or grind the work 28.

Also, because the grindstone interference diameter is substantially 60% or more of the grindstone interference diameter that is obtained when the spindle swing angle is 0°, there can be reduced the need to rotate the grindstone 26 at a high speed.

Further, since the grindstone interference diameter can be secured, the number of abrasive grains of the grindstone surface actually used in the grinding operation need not be reduced but a given number of abrasive grains can be secured, which makes it possible to decrease the possibility that the grindstone 26 can be clogged, thereby being able to decrease the need for frequent dressing of the grindstone 26. This not only is advantageous from the viewpoint of the working or grinding cycle, but also can reduce the time that is necessary for replacement of the grindstone 26, thereby being able to enhance the productivity of the work 28.

Although a description has been given heretofore of the first embodiment of the invention, the invention can also be changed and modified in other various manners than the above-mentioned first embodiment. Now, a description will be given below of other embodiments of the invention.

By the way, in the above-mentioned first embodiment, in the grinding operation, the work may be ground while the spindle swing angle $\theta_1$ is fixed or varied. When varying the spindle swing angle $\theta_1$, it is necessary to control the positions of the grindstone 26 and work 28. If the spindle swing angle $\theta_1$ can be set at a proper value by such position control, then the grinding or working time can be further shortened.

(Second Embodiment)

Now, a description will be given below of a second embodiment of a method for grinding the traction surface of a half-toroidal CVT disk according to the invention with reference to FIG. 1 as well as FIGS. 8 through 14.

In the previously described first embodiment, the swing angle $\theta_1$ (cutting angle $\theta_2$) of the grindstone 26 with respect to the axis of the work 28 such as a half-toroidal CVT disk or the like is set in the range of approx. 15°–40°. However, in fact, the proper swing angle of the grindstone 26 depends on the dimensions of the work 28. In view of this, the second embodiment relates to a grinding method capable of grinding even a work 28 for which a swing angle of 15° or less is preferred.

Here, in FIG. 8, there are shown a cutting angle $\theta_2$ and a swing angle $\theta_1$ which are respectively used in the following description.

Figure 8:
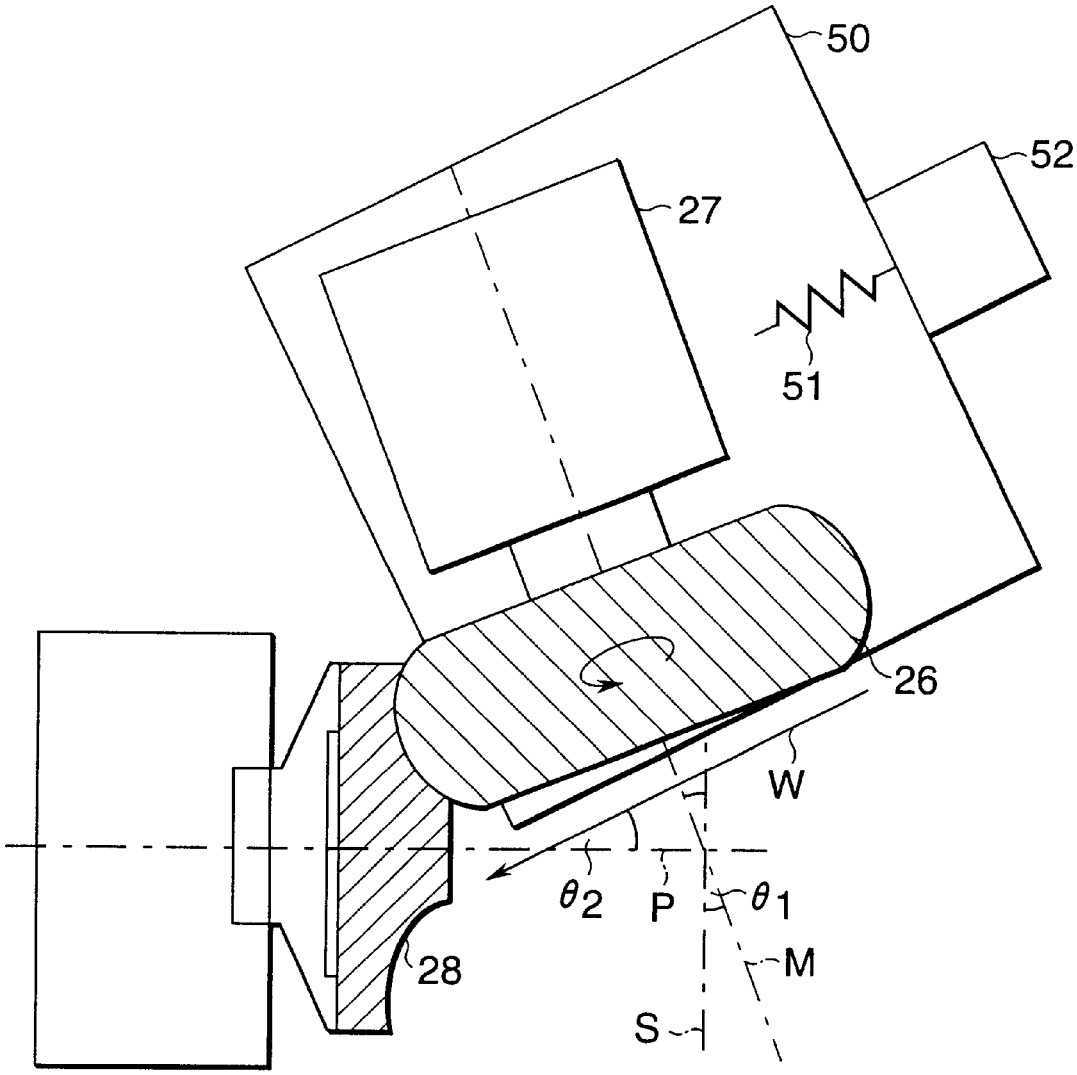
FIG. 8 is a view of the relationship between a cutting angle $\theta_2$ and a swing angle $\theta_1$ when a work is ground by a grindstone according to a second embodiment of the invention.

In FIG. 8, a grindstone spindle 27, to which the grindstone 26 is fixed, is mounted on a grindstone table 50 (not shown) which corresponds to the cutting table 23 in FIG. 1. On the grindstone table 50, there is disposed a feed screw 51; and, by adjusting the feed amount of the feed screw 51, the inclination angles of the grindstone 26 and grindstone spindle 27 with respect to the grindstone table 50 can be adjusted. Also, in order to be able to drive the grindstone 26 to cut the work 28, there is disposed a grindstone table drive motor 52. Therefore, if the grindstone table drive motor 52 is operated, then the grindstone drive motor 52 can be made to move toward a given direction of the grindstone table 50(a cutting direction W).

And, in FIG. 8, an angle, which is formed by the center axis P of the work 28 and the cutting direction W of the grindstone table 50, is expressed as $\theta_2$; and, an angle, which is formed by the center axis M of the grindstone 26 and a perpendicular line S meeting at right angles to the center axis P of the work 28, is expressed as a swing angle $\theta_1$.

Therefore, when the cutting direction W and the center axis M intersect each other at right angles, the cutting angle $\theta_2$ and the swing angle $\theta_1$ are equal to each other; but, when the cutting direction W and the center axis M meet each other at other angles than right angles, the cutting angle $\theta_2$ and the swing angle $\theta_1$ are not equal to each other.

Now, a description will be given below using these cutting angle $\theta_2$ and swing angle $\theta_1$.

In the previously described first embodiment, the values of the cutting magnifications 1 and 2 are obtained respectively for the outside and inside buttings between the grindstone and work. However, actually, the value of the cutting magnification becomes the smallest when the grindstone 26 is in inside and outside butted against the work at the same time.

Figure 11:
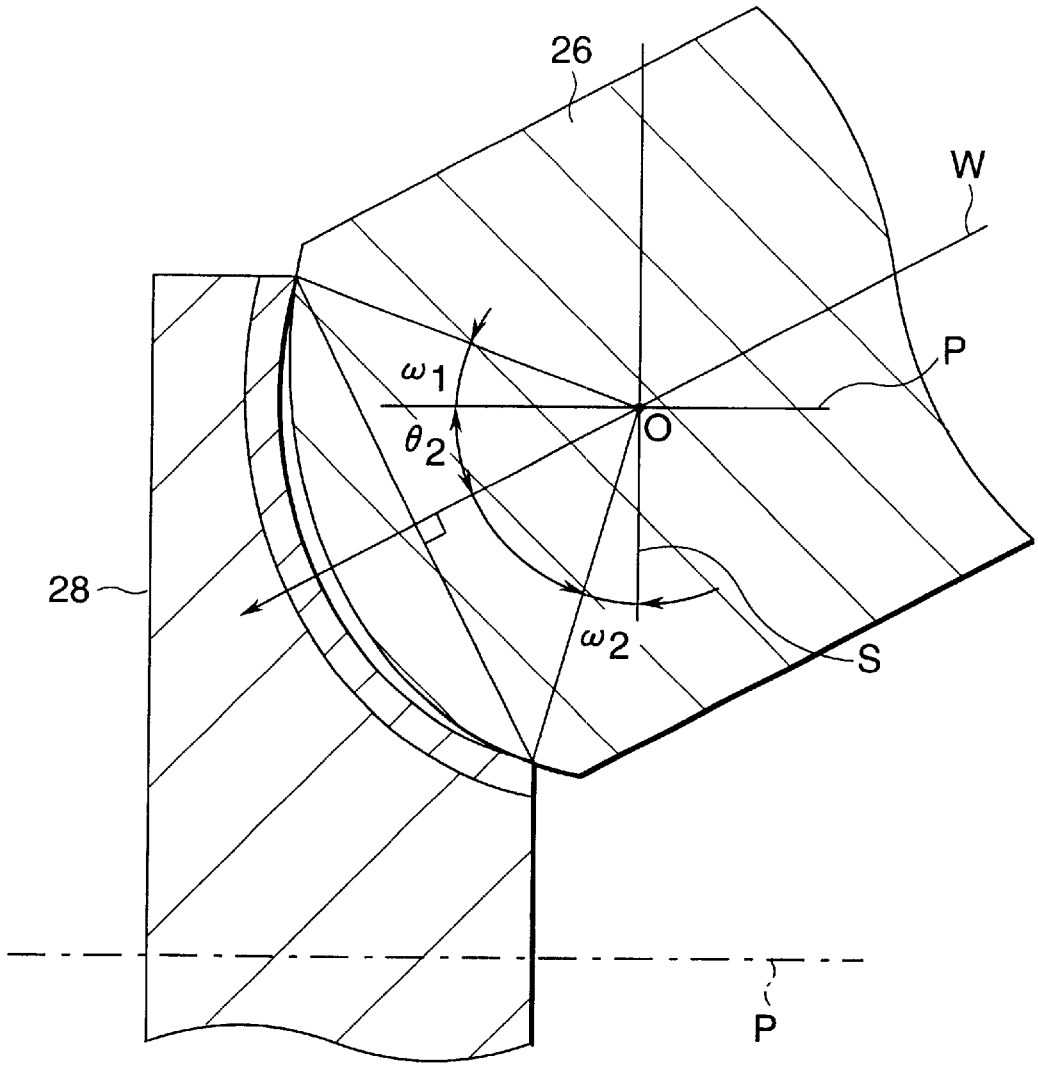
FIG. 11 is a view of a grindstone and a work according to the second embodiment, showing a state in which they are inside and outside butted with each other at the same time.

That is, when the grindstone 26 is inside and outside butted at the same time, as shown in FIG. 11, the traction surface of the work 28 and the grinding surface of the grindstone 26 are respectively formed in a arcuate shape so as to have their given radii and, therefore, the cutting magnifications for the inside and outside buttins are equal to each other.

In this case, from the previously described first embodiment, the cutting magnifications 1 and 2 can be obtained by the following expressions using the cutting angle $\theta_2$: that is, $$\text{Cutting magnification } \mathbf{1}\text{: } t'/t1/\cos(\theta_2+\omega\mathbf{1}) \qquad \text{Expression 15}$$

$$\text{Cutting magnification } \mathbf{2}\text{: } t'/t1/\cos(\pi/2-\theta_2-\omega\mathbf{2}) \qquad \text{Expression 16.}$$

Actually, the cutting magnification becomes the smallest when the grindstone 26 carries out a cutting operation in which the grindstone 26 starts to come into contact with the outer and inner peripheries of the traction surface of the work 28 at the same time. FIG. 11 shows an imaginary view of this case.

A cutting angle $\theta_2$ at the then time is an angle obtained when the two cutting magnifications 1 and 2 are equal to each other and thus the cutting angle $\theta_2$ at the then time can be obtained by the following expression: that is, $$\theta_2=(\pi/2-\omega\mathbf{1}-\omega\mathbf{2})/2)/2 \qquad \text{Expression 17.}$$

As can be seen from the above, the cutting magnification is a ratio of an apparent machining allowance t' to a given machining allowance t and, when the grinding operation is executed at a constant cutting speed, from the viewpoint of shortening the grinding time, preferably, the grinding operation maybe executed at this cutting angle which makes the cutting magnification smallest.

Figure 9A:
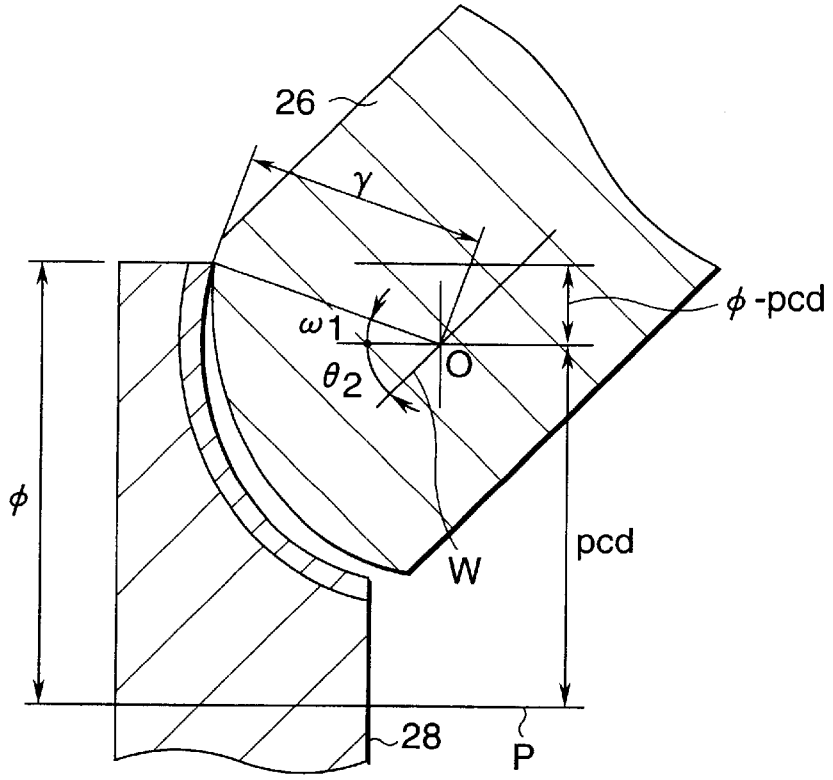
FIGS. 9A and 9B are views of a grindstone and a work according to the second embodiment, showing a state in which they are outside butted with each other.
Figure 9B:
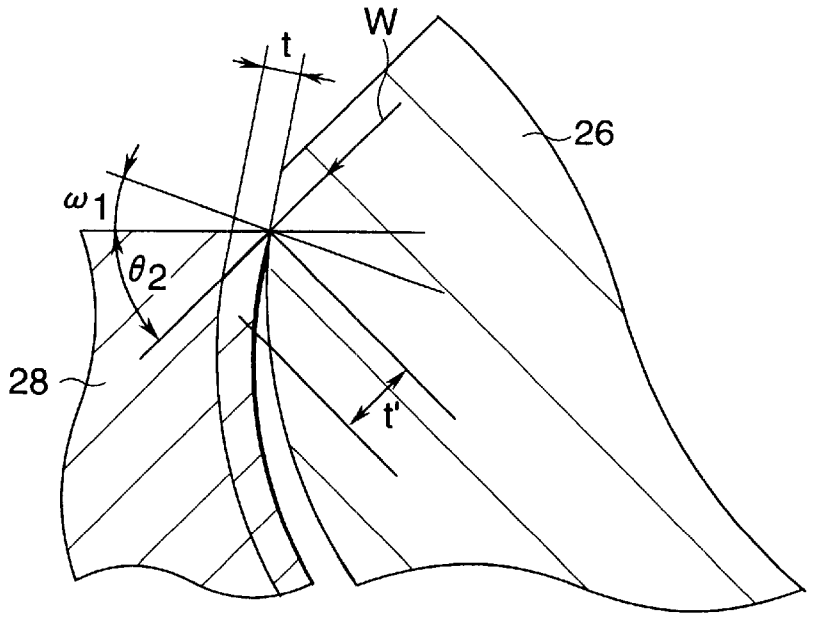
Figure 10A:
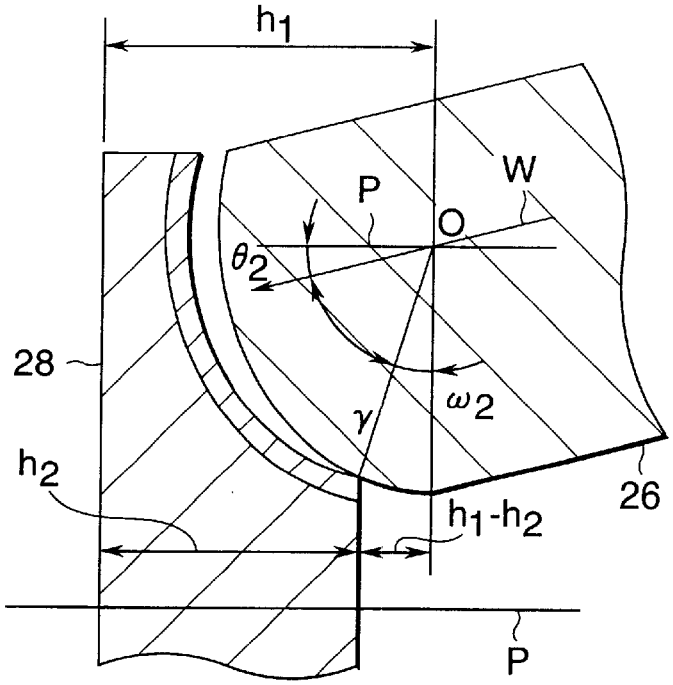
FIGS. 10A and 10B are views of a grindstone and a work according to the second embodiment, showing a state in which they are inside butted with each other.
Figure 10B:
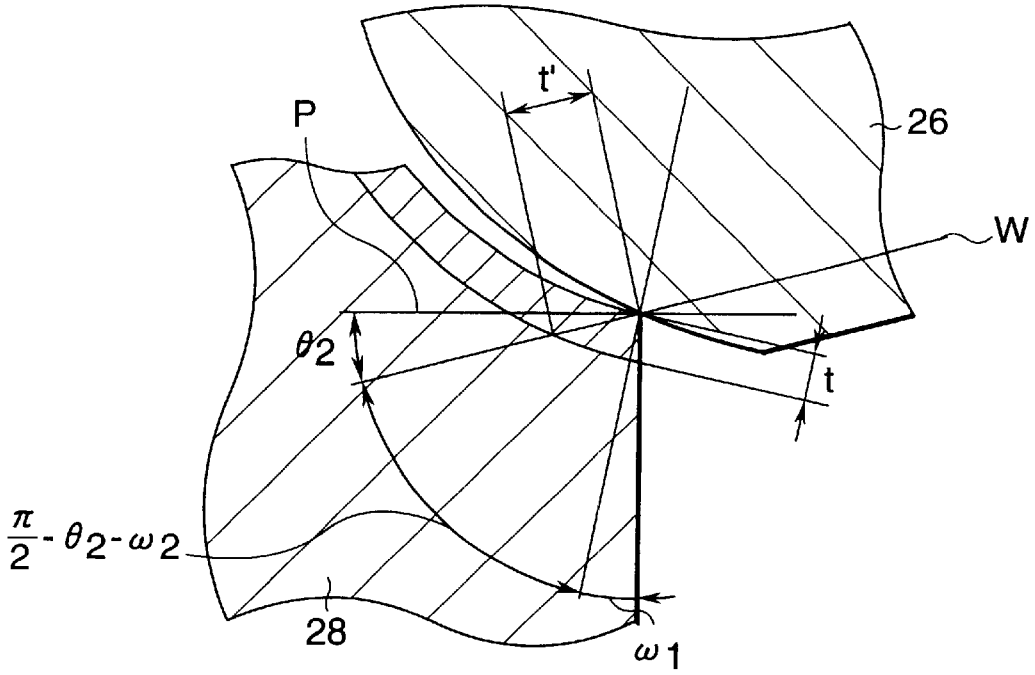

In this case, if $\omega\mathbf{1}$ and $\omega\mathbf{2}$ are calculated from FIGS. 9 and 10 and are substituted into Expression 17, then there can be obtained the following expression: that is, $$\theta_2=\tfrac{1}{2}\{\pi/2-(\arcsin(\phi-pcd)/r+\arcsin(h1-\mathrm{h}\mathbf{2})/r\} \qquad \text{Expression 18.}$$

When the cutting angle $\theta_2$ satisfies the above relationship, the cutting magnification becomes the smallest, so that the working or grinding time can be made the shortest.

Figure 12:
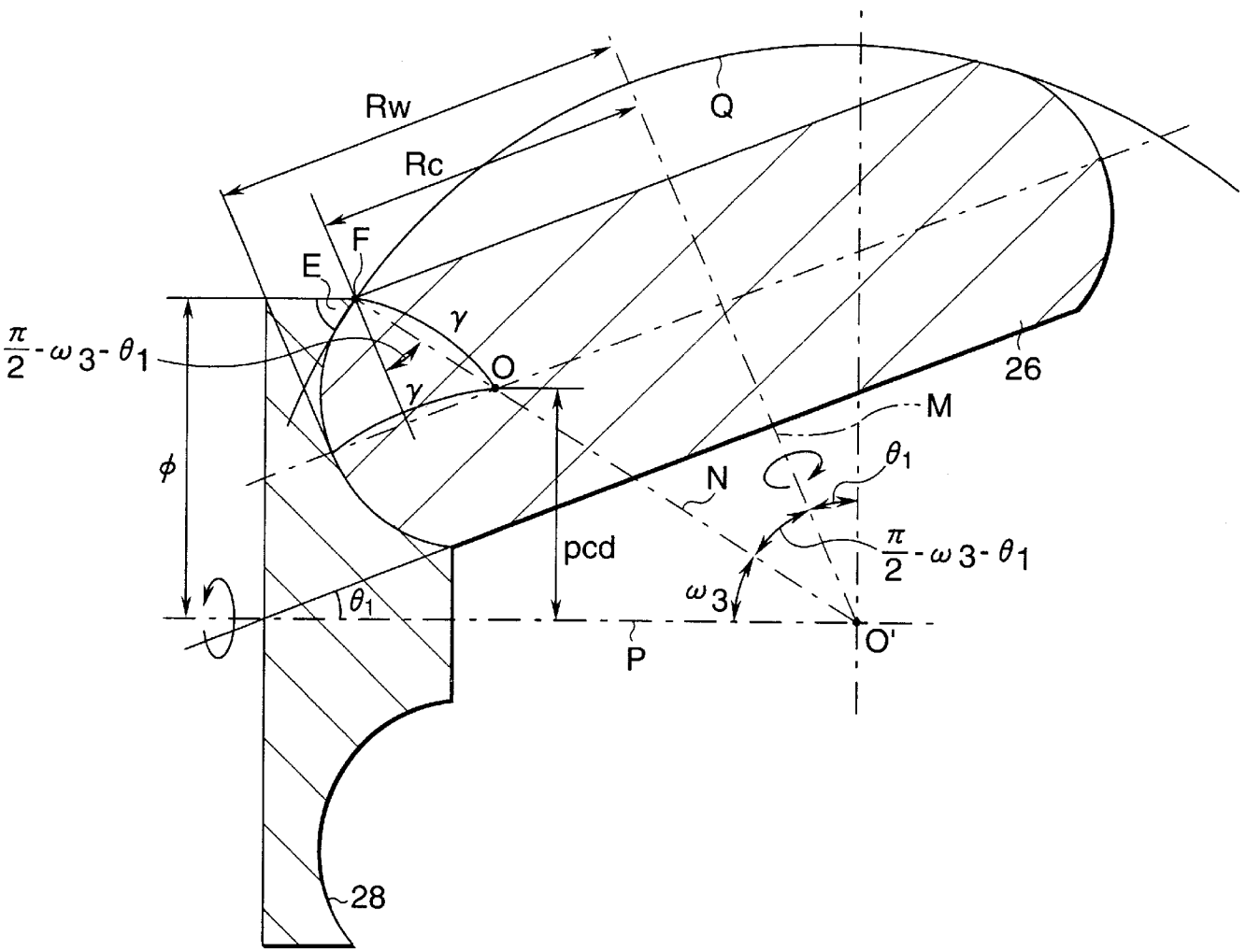
FIG. 12 is a graphical representation of the interference relationships between the grindstone and work according to the second embodiment.

Here, when grinding the traction surface of the work 28, it is required that, over the whole area of the traction surface up to the edge portion E of the work 28 shown in FIGS. 11 and 12, the generator shape of the grindstone 26 is transferred to the traction surface of the work 28. By the way, the fact that, in the vicinity of the edge portion E, the grindstone 26 and work 28 are contacted with each other in other area than a given grinding area is hereinafter referred to as "interference", and, if the interference occurs, then the generator shape of the traction surface of the work 28 becomes dull or other similar poor results can occur. In the following description, there is obtained the maximum diameter of the grindstone 26 which allows the grinding operation to be carried out without causing the grindstone 26 to produce any interference with the work 28.

At first, as shown in FIG. 12, in order to prevent the grindstone 26 and work 28 from interfering with each other in the respective points of the traction surface of the work 28, it is necessary that the grindstone 26 does not stick out from a virtual sphere Q which has, as a center thereof, the intersection O' of the normal line N of the tangent line at the edge portion E of work 28 and the center axis P of the rotary shaft of the work 28, and a radius equal to a distance from the intersection O' to the traction surface of the work 28.

Here, in order to prevent a possibility that the edge portion E can be interfered and ground, it is necessary to receive the grindstone 26 in a certain area, that is, it is necessary that the grindstone 26 does not stick out from a virtual sphere Q which has, as a center thereof, the intersection O' of a normal line N at a point F on the outer-most side of the traction surface and the center axis P, and a radius equal to a distance from the intersection O' to the traction surface of the work 28.

If the grindstone 26 is received within such sphere Q, then the all remaining working or grinding points can be received within the above-mentioned sphere Q, which makes it possible for the grindstone 26 to grind the traction surface of the work 28 without causing interference between the work 28 and grindstone 26.

Accordingly, according to the following expressions, there can be obtained the maximum diameter of the grindstone 26 which permits the grindstone 26 to grind the work 28 with no interference between them.

As shown in FIG. 12, firstly, if an angle formed by the normal line of the outer-most peripheral portion of the traction surface of the work 28 and the rotary shaft of the work 28 is expressed as ω3, then there can be obtained the following expression:

$$\omega 3 = \arcsin\{(\phi - pcd)/r\} \qquad \text{Expression 19}$$

Then, the radius Rc of the portion of the grindstone 26 that grinds the outer-most peripheral portion of the traction surface of the work 28 can be obtained by the following expression, using the swing angle $\theta_1$:

$$Rc = (\phi/\sin(\omega 3)\cdot\sin(\pi/2\omega 3 - \theta_1) \qquad \text{Expression 20}$$

Further, the maximum radius Rw of the grindstone 26 can be obtained by the following expression:

$$Rw = Rc + r\{1 - \sin(\pi 2 - \omega 3 - \omega_1) \qquad \text{Expression 21}$$

Thus, if the dimensions (pcd, r, outside diameter) of the work 28 and the swing angle $\theta_1$ of the grindstone 26 are determined, from the expression of the maximum radius Rw of the grindstone 26, there can be obtained the maximum radius of the grindstone 26 that permits the grindstone 26 to grind the work 28. That is, the grindstone 26 having such dimensions is the grindstone 26 that can grind the traction surface of the work 28 most efficiently.

From the above description, when the swing angle of the grindstone 26 is set so that the grindstone 26 can be butted inside and outside against the work at the same time and the outside diameter of the grindstone 26 is set based on the above-mentioned Rw, the grindstone 26 is able to grind the work 28 most efficiently.

Figure 13:
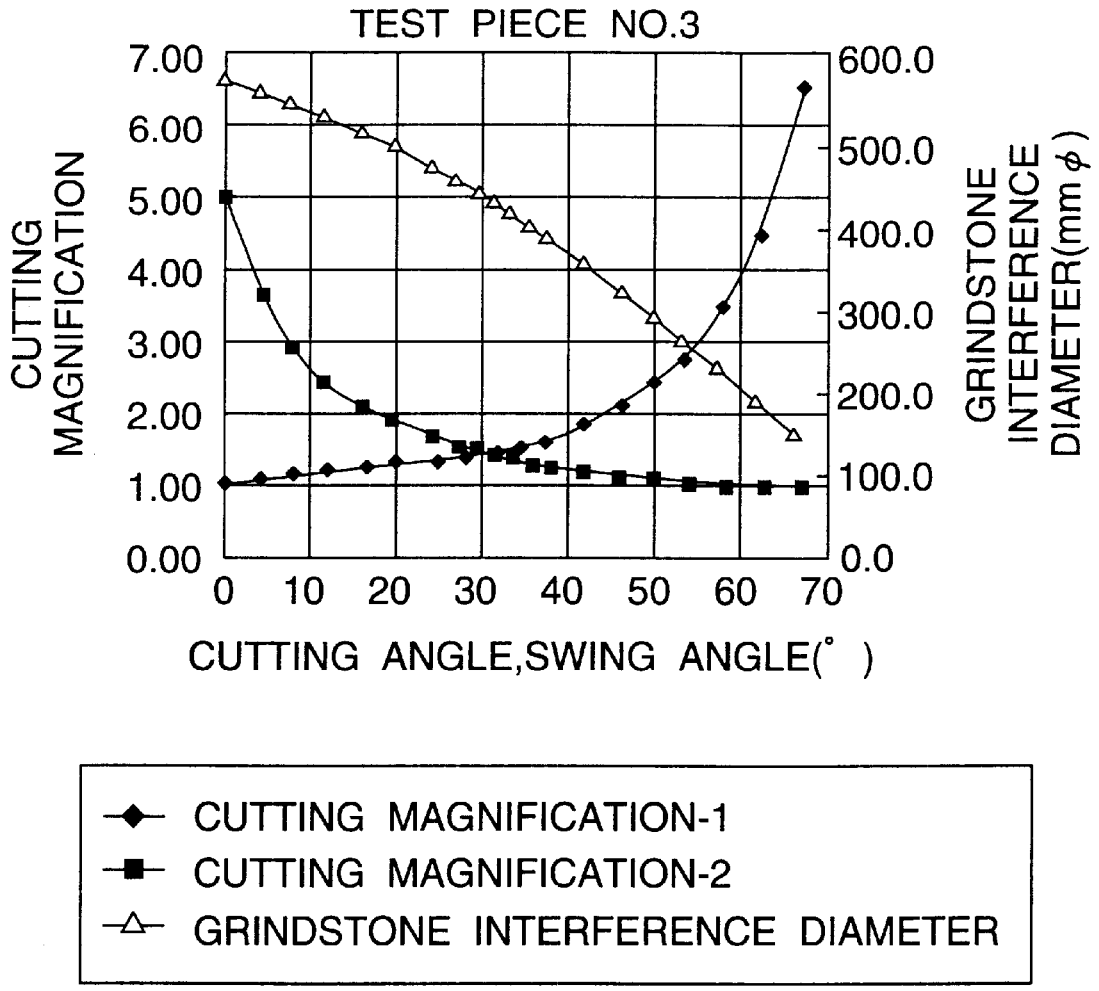
FIG. 13 is a graphical representation of the relationships among cutting angles, cutting magnifications, swing angles and grindstone interference diameters in a test piece No. 3 according to the second embodiment; and, FIG. 14 is a graphical representation of the relationships among cutting angles, cutting magnifications, swing angles and grindstone interference diameters in a test piece No. 4 according to the second embodiment.

Here, Table 6 shows the cutting angles of a test piece No. 3 shown in Table 5 and the cutting magnifications 1 and 2 at these cutting angles, while the cutting magnifications 1 and 2 are the results that are obtained by calculation according to the above-mentioned expression. Also, Table 7 shows the swing angles of the test piece No. 3 as well as the grindstone interference diameters at these swing angles, while the grindstone interference diameters are the results that are obtained by calculation according to the above-mentioned expression. Further, FIG. 13 is a graphical representation of the cutting angles, swing angles as well as the cutting magnifications 1, 2 and grindstone interference diameters.

TABLE 5

| Test Piece No. 3 | | | |
|---|---|---|---|
| Dimension of parts [mm] | Outer Diameter | ϕ × | 153.0 |
| | PCD | pcd × | 132.0 |
| | Groove R | r | 40.0 |
| | PC height | h1 | 53.0 |
| | Width | h2 | 45.0 |
| Traction surface [deg] | Outer edge angle | ω1 | 15.2 |
| | Inner edge angle | ω2 | 11.5 |
| | Surface angle | a' | 31.6 |

TABLE 6

| Cutting Angles | Cutting Magnifications 1 | Cutting Magnifications 2 |
|---|---|---|
| 0 | 1.04 | 5.00 |
| 4 | 1.06 | 3.73 |
| 8 | 1.09 | 2.99 |
| 12 | 1.12 | 2.50 |
| 16.6 | 1.18 | 2.12 |
| 20 | 1.22 | 1.91 |
| 25 | 1.31 | 1.68 |
| 28 | 1.37 | 1.57 |
| 30 | 1.42 | 1.51 |
| 31.6 | 1.46 | 1.46 |
| 32 | 1.47 | 1.45 |
| 34 | 1.53 | 1.40 |
| 36 | 1.60 | 1.36 |
| 38 | 1.67 | 1.31 |
| 42 | 1.85 | 1.24 |
| 46.6 | 2.12 | 1.18 |
| 50 | 2.39 | 1.14 |
| 54 | 2.82 | 1.10 |
| 58 | 3.46 | 1.07 |
| 62 | 4.52 | 1.04 |
| 66 | 6.55 | 1.02 |

TABLE 7

| Swing Angles | Grindstone Interference Diameter |
|---|---|
| 0 | 565.2 |
| 4 | 554.8 |
| 8 | 542.1 |
| 12 | 527.2 |
| 16.6 | 507.3 |
| 20 | 490.8 |
| 25 | 464.0 |
| 28 | 446.5 |
| 30 | 434.2 |
| 31.6 | 424.1 |
| 32 | 421.5 |
| 34 | 408.5 |
| 36 | 395.0 |

TABLE 7-continued

| Swing Angles | Grindstone Interference Diameter |
|---|---|
| 38 | 381.1 |
| 42 | 352.3 |
| 46.6 | 317.5 |
| 50 | 290.8 |
| 54 | 258.4 |
| 58 | 225.2 |
| 62 | 191.2 |
| 66 | 156.8 |

From Table 6, in the work 28 that corresponds to the test piece No. 3, when the cutting angle is 31.6°, the cutting magnifications 1 and 2 are both 1.46. When the cutting angle takes any other value than this value, that is, 31.6, either of the cutting magnification 1 or 2 takes a larger value than 1.46. Accordingly, when the cutting magnifications 1 and 2 are both 1.46, the cutting magnification is the smallest.

Also, from the results of Table 6, if the cutting angle is set in the range of 31.6°±15°, that is, in the range of 16.6° to 46.6° , then the cutting magnification can be restricted to 2.12 or less. Further, from Table 7, if the swing angle is set at 31.6°, that is, at the same angle as the cutting angle that makes the cutting magnification smallest, then the then grindstone interference diameter is 424.1 mm.

However, when the outside diameter of the grindstone 26 takes this value, the grindstone 26 is butted against the traction surface of the work 28 in a surface butted state and, in such surface butted state, grinding water will not enter the grinding surface of the work 28 in the grinding operation, which raises a problem that the portion to be ground can be burned due to friction.

For this reason, as a grindstone 26 to be actually used to grind the work 28, it is necessary to use a grindstone 26 having an outside diameter smaller than a value 0.9 times 424.1 mm, that is, an outside diameter smaller than 381.7 mm. By the way, as a grindstone 26 having a standard dimension, there is used a grindstone 26 which has an outside diameter of 355 mm.

Here, when the swing angle is set at 25°, the grindstone interference diameter at this angle is 464 mm. In this case, as a grindstone 26 to be actually used to grind the work 28, it is necessary to use a grindstone 26 having an outside diameter smaller than a value 0.9 times 464 mm, that is, an outside diameter smaller than 417.6 mm. As a grindstone 26 having a standard dimension, there is used a grindstone 26 which has an outside diameter of 405 mm.

When grinding efficiency and grinding accuracy are taken into consideration, it is believed that a grindstone having an outside diameter of 405 mm is advantageous over a grindstone having an outside diameter of 355 mm. Also, when the cutting and swing angles are both set at the same angle, that is, 25°, the cutting magnification becomes 1.68 which is 115% of the cutting magnification 1.46 obtained for the above-mentioned cutting angle of 31.6°.

However, from the viewpoint of the grinding efficiency and the like, it is believed that the swing angle of 25° can provide the best grinding performance and, therefore, the swing angle of 25° is believed to be the optimum value for the comprehensive grinding performance.

Figure 14:
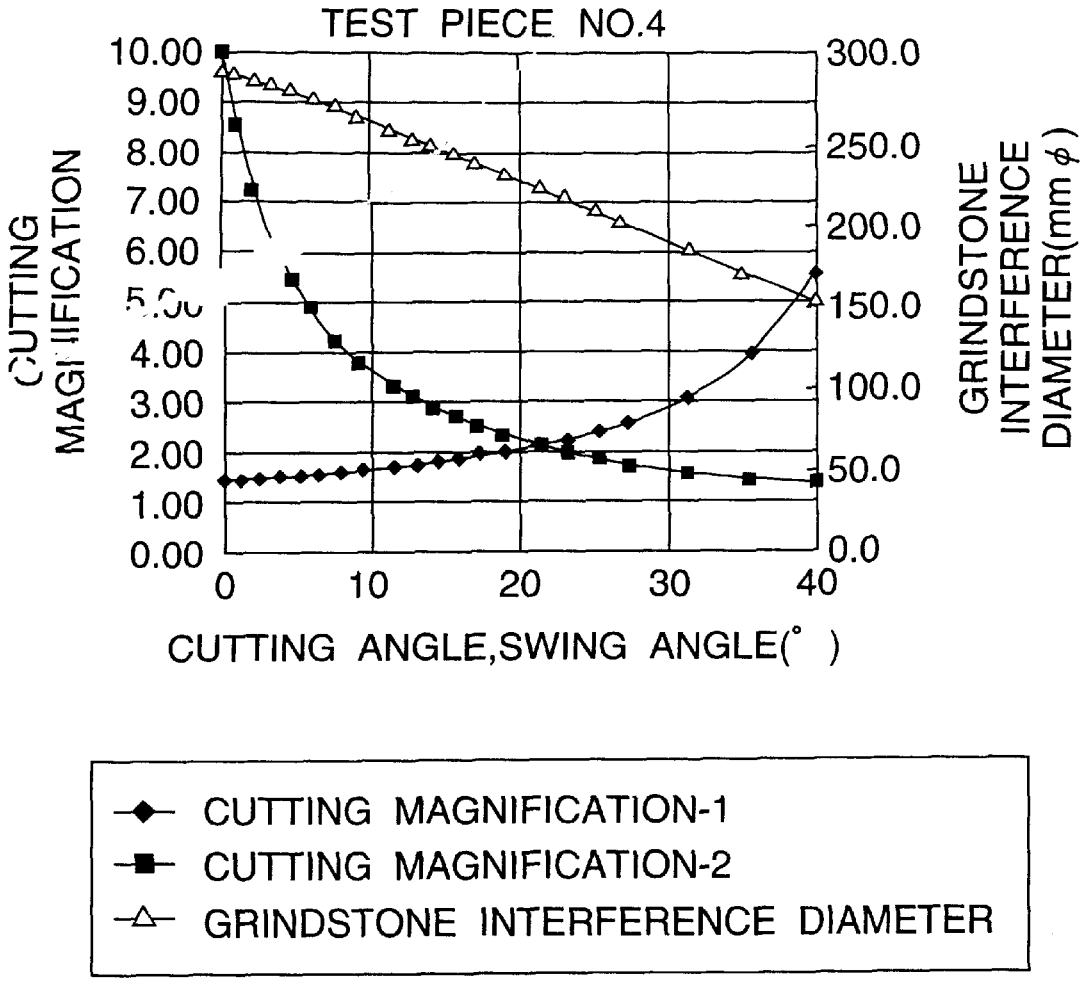

Also, Table 9 shows the cutting angles of a test piece No. 4 shown in Table 8 and the cutting magnifications 1 and 2 at their associated cutting angles, while the cutting magnifications 1 and 2 are the results that are obtained by calculation according to the above-mentioned expression. Also, in Table 10 shows the swing angles of the test piece No. 4 as well as the grindstone interference diameters at their associated swing angles, while the grindstone interference diameters are the results that are obtained by calculation according to the above-mentioned expression. Further, FIG. 14 is a graphical representation of the cutting angles, swing angles as well as the results of the cutting magnifications 1, 2 and grindstone interference diameters of the test piece No. 4.

TABLE 8

| Test Piece No. 4 | | | |
|---|---|---|---|
| Dimension of parts [mm] | Outer Diameter | ϕ × 2 | 218.0 |
| | PCD | pcd × 2 | 155.0 |
| | Groove R | r | 50.0 |
| | PC height | h1 | 75.0 |
| | Width | h2 | 70.0 |
| Traction surface [deg] | Outer edge angle | ω1 | 39.1 |
| | Inner edge angle | ω2 | 5.7 |
| | Surface angle | a' | 22.6 |

TABLE 9

| Cutting Angles | Cutting Magnifications 1 | Cutting Magnifications 2 |
|---|---|---|
| 0 | 1.29 | 10.00 |
| 1 | 1.31 | 8.52 |
| 2 | 1.33 | 7.43 |
| 4 | 1.37 | 5.91 |
| 5 | 1.39 | 5.37 |
| 6 | 1.42 | 4.92 |
| 8 | 1.47 | 4.21 |
| 10 | 1.53 | 3.69 |
| 12 | 1.59 | 3.28 |
| 14 | 1.66 | 2.96 |
| 15 | 1.70 | 2.82 |
| 16 | 1.75 | 2.70 |
| 18 | 1.84 | 2.48 |
| 20 | 1.94 | 2.30 |
| 22.6 | 2.11 | 2.11 |
| 24 | 2.21 | 2.02 |
| 26 | 2.37 | 1.90 |
| 28 | 2.56 | 1.80 |
| 32 | 3.08 | 1.63 |
| 36 | 3.88 | 1.50 |
| 40 | 5.26 | 1.40 |

TABLE 10

| Swing Angles | Grindstone Interference Diameter |
|---|---|
| 0 | 291.1 |
| 1 | 288.3 |
| 2 | 285.5 |
| 4 | 279.8 |
| 5 | 276.8 |
| 6 | 273.8 |
| 8 | 267.6 |
| 10 | 261.2 |
| 12 | 254.7 |
| 14 | 247.9 |
| 15 | 244.4 |
| 16 | 240.9 |
| 18 | 233.8 |
| 20 | 226.5 |
| 22.6 | 216.8 |
| 24 | 211.5 |
| 26 | 203.8 |
| 28 | 195.9 |
| 32 | 179.9 |
| 36 | 163.5 |
| 40 | 146.7 |

From Table 9, in the work 28 which corresponds to the test piece No. 4, when the cutting angle is 22.6°, the cutting magnification 1 and 2 are both 2.11, so that the cutting magnification becomes smallest. Also, from Table 10, when the swing angle is 22.6°, the grindstone interference diameter is 216.8 mm and, as a grindstone 26 to be actually used to grind the work 28, it is necessary to use a grindstone 26 having an outside diameter smaller than a value 0.9 times 216.8 mm, that is, an outside diameter smaller than 195.1 mm. In this case, as a grindstone 26 having a standard dimension, there can be actually used a grindstone 26 having an outside diameter of 180 mm.

On the other hand, if the swing angle is set at 0°, then the then grindstone interference diameter is 291.1 mm and, as a grindstone 26 to be actually used to grind the work 28, it is necessary to use a grindstone 26 having an outside diameter smaller than a value 0.9 times 291.1 mm, that is, an outside diameter smaller than 262.0 mm. By the way, in a grindstone 26 having a standard dimension, the outside diameter thereof is 255 mm. And, a grindstone 26, which is actually used in the work grinding operation, employs this dimension. Therefore, when the swing angle is set at 0°, it is possible to use a grindstone 26 having an outside diameter 141.7% of an outside diameter obtained when the swing angle is 22.6°.

However, if the cutting angle is set at the same angle as the swing angle, that is, at 0°, then the cutting magnification 2 becomes 10, which raises a problem that the apparent machining allowance t' can be outstandingly large to thereby increase the working or grinding time.

In view of this, if the cutting and swing angles are both set at 15°, then the cutting magnification 2 is 2.82 and, therefore, the then cutting magnification can be restricted to 134% of 2.11 which is the smallest value of the cutting magnification in the test piece No. 4.

Also, when the cutting angle $\theta_2$ is different from the swing angle $\theta_1$, the working or grinding surfaces of the grindstone 26 are not symmetrical and, therefore, grinding forces acting on the grindstone 26 and work 28 act not only in the radial direction of the grindstone 26 but also in the axial direction of the rotary shaft of the grindstone 26. Here, since the thrust rigidity of the grindstone 26 in the axial direction thereof is weaker than the radial rigidity thereof, it is not desirable that the grinding force acts in the axial direction of the grindstone 26. Therefore, it is desirable that a difference between the cutting angle $\theta_2$ and the swing angle $\theta_1$ is small.

Here, if the difference between the cutting angle $\theta_2$ and the swing angle $\theta_1$ is equal to or larger than 15°, then the axial-direction component of the grinding force becomes too large, that is, it is desirable that the difference between the two angles is smaller than 15°.

In other words, if $|\theta_1-\theta_2|\leqq 15°$, then it is possible to reduce the thrust load that is generated in the grindstone 26.

As described above, from the results obtained in connection with the test pieces No. 3 and No. 4, if the cutting angle $\theta_2$ is set in the range of the angle making the cutting magnification smallest ±15°, the difference between the swing and cutting angles is restricted to 15° or less, and the grindstone outside diameter is restricted to a value 0.9 times to 0.5 times the grindstone interference diameter, then it is possible to carry out a proper grinding operation which can ensure compatibility in grinding efficiency and grinding accuracy.

According to this method for grinding the traction surface of a half-toroidal CVT disk, the cutting angel $\theta_2$, which is an angle to be formed by the cutting direction W of the grindstone 26 with respect to the axis of the work 28, is set in the range of ±15° with respect to the angle that makes smallest the cutting magnification, that is, a ratio of an apparent machining allowance to a given machining allowance. Then, the apparent cutting magnification does not become so large but can be restricted to a small range.

In addition to this, since an angle difference between the swing angel $\theta_1$, which is an angle to be formed by the rotation surface direction of the grindstone 26 with respect to the axis of the work 28, and the cutting angle $\theta_2$ is set in the range of 15° or less. A load to be applied in the thrust direction of the grindstone 26 does not become large, which makes it possible to prevent an inconvenience that a thrust load can be applied to the grindstone 26 to thereby break or damage the same.

Also, because the cutting angle $\theta_2$ is set in the range of 15° or less with respect to the angle that makes the cutting magnification smallest, if the cutting magnification is obtained by the cutting angle $\theta_2$ in this range, then the cutting magnification can be prevented from being unfavorably larger than the smallest value of the cutting magnification. In this case, by setting the cutting angle $\theta_2$ at a proper angle, it is possible to ensure compatibility in the cutting magnification and the maximum diameter of the grindstone 26.

Due to this, the grinding performance of the work 28 can be made comprehensively enhanced, thereby being able to shorten the grinding or working time.

Also, since the diameter of the grindstone 26 is set in such a manner that the grindstone 26 will not cause any interference with respect to the work, the grinding operation can be carried out in such a manner that there are removed the possible causes of the poor surface quality such as the dull shape, re-grinding or the like.

Further, because the grindstone interference diameter of the grindstone 26 is obtained from the swing angle $\theta_1$ and the diameter of the grindstone 26 is set in the range of values 0.9 times to 0.5 times the thus obtained grindstone interference diameter, the diameter of the grindstone 26 actually used can be made the largest within the allowable range. This makes it possible to shorten the grinding time.

And, due to the combined effect of these factors, the grindstone peripheral speed can be made high without increasing the number of rotations of the grindstone, thereby being able to provide a grinding method which is capable of grinding the work with high rigidity and high efficiency. Also, a grinding machine meeting these conditions can be made a grinding machine which is capable of grinding the work with high rigidity and high efficiency.

Accordingly, thanks to the above, the working or grinding cycle time can be reduced.

Also, since a sufficient usable range of the grindstone 26 can be secured, the frequency of dressing and replacement of the grindstone 26 can be reduced. This makes it possible to increase a time ratio of an actual grinding time to a general grinding operation time, thereby being able to enhance the grinding performance of the grinding machine.

Although description has been given heretofore of the second embodiment of a method for grinding the traction surface of a half-toroidal CVT disk according to the invention, according to the invention, other various changes and modifications are also possible. A description will be given below of such changes and modifications.

That is, in the above-mentioned embodiment, the grinding operation is executed under the following conditions: that is, the cutting angle $\theta_2$ is set in the range of 15° or less with respect to the angle that makes the cutting magnification smallest (1), the angle difference between the cutting angle $\theta_2$ and the swing angle $\theta_1$ is set equal to or larger than 15° (2), the diameter of the grindstone 26 is set to be 0.9 times to 0.5 times the interference diameter of the grindstone 26 that can be calculated from the swing angle (3). However, the invention can also employ a structure capable of executing a grinding operation which satisfies at least one of these three conditions (1)–(3).

Other various changes and modifications are also possible without departing from the subject matter of the invention.

As has been described heretofore, according to the invention, the swing angle of a tool with respect to the axis of a half-toroidal CVT disk is set in the range of about 15° to 40°, whereby the grindstone interference diameter of the half-toroidal CVT disk is about 60% or more of the grindstone interference diameter that is obtained when the swing angle is 0°. Also, an apparent machining allowance can be controlled down to a value double an actual machining allowance or less, which makes it possible to shorten the working or grinding time. Further, since the grindstone interference diameter is about 60% or more of the grindstone interference diameter that is obtained when the swing angle is 0°, the need to rotate the grindstone at a high speed can be reduced. In addition, because the grindstone interference diameter is secured, it is possible to secure a sufficiently wide usable range for the grindstone to thereby reduce the frequency of replacement of the grindstone, which is an advantage in the working or grinding cycle.

What is claimed is:

1. A method for grinding a traction surface of a half-toroidal CVT disk, comprising the steps of:

preparing a grinding machine including a hold mechanism holding the half-toroidal CVT disk having a given machining allowance, and a machining mechanism including a tool for grinding the half-toroidal CVT disk, the grinding of said grinding machine being performed in a state that one of the half-toroidal CVT disk and said tool is inclined at a predetermined angle with respect to the other; and setting a cutting angle, which is an angle to be formed by a cutting direction of said tool with respect to an axis of the half-toroidal CVT disk, in the range of ±15° with respect to an angle that a first cutting magnification at a time that said tool contacts with an outer periphery position of the traction surface of the half-toroidal CVT disk is substantially equal to a second cutting magnification at a time that said tool contacts with an inner periphery position of the traction surface, each of said first and second cutting magnification at the time that said tool contacts with an inner periphery position of the traction surface, each of said first and second cutting magnifications being a ratio of an apparent machining allowance to the given machining allowance.

2. A method according to claim 1, further comprising the steps of;

setting an angle difference between said cutting angle and a swing angle, which is an angle to be formed by the rotation axis of said tool with respect to a surface perpendicular to the axis of said half-toroidal CVT disk, in the range of 15° or less by absolute angle.

3. A method according to claim 2 further comprising the steps of:

determining the maximum diameter of said tool in the range of 0.9 times to 0.5 times an interference grindstone diameter, said interference grindstone diameter being calculated from a dimension between the center of curvature of a curved surface of said traction surface of the half-toroidal CVT disk and the rotation center of said half-toroidal CVT disk, the dimension of the radius of curvature of said traction surface, the dimension of the outer peripheral diameter of said traction surface, and said swing angle.

4. A method according to claim 3, wherein said swing angle is set to be equal to the cutting angle, and to be in the range of 15°–40°.

5. A method according to claim 2, wherein said swing angle is set to be equal to the cutting angle, and to be in the range of 15°–40°.

6. A method according to claim 1, wherein a swing angle, which is an angle to be formed by the rotation axis of said tool with respect to a surface perpendicular to the axis of said half-toroidal CVT disk, is set to be equal to the cutting angle, and to be in the range of 15°–40°.

7. A method for grinding a traction surface of a half-toroidal CVT disk, comprising the steps of:

preparing a grinding machine including a hold mechanism holding the half-toroidal CVT disk having a given machining allowance, and a machining mechanism including a tool for grinding the half-toroidal CVT disk, the grinding of said grinding machine being performed in a state that one of the half-toroidal CVT disk and said tool is inclined at a predetermined angle with respect to the other; and setting a swing angle, which is an angle to be formed by a rotation axis of said tool with respect to a surface perpendicular to an axis of said half-toroidal CVT disk so that an angle difference between a cutting angle, which is an angle to be formed by a cutting direction of said tool with respect to the axis of the half-toroidal CVT disk, and the swing angle is 15° or less by absolute angle.

8. A method according to claim 7, wherein said swing angle is set to be equal to the cutting angle, and to be in the range of 15°–40°.

9. A method for grinding a traction surface of a half-toroidal CVT disk, comprising the steps of:

preparing a grinding machine including a hold mechanism holding the half-toroidal CVT disk having a given machining allowance, and a machining mechanism including a tool for grinding the half-toroidal CVT disk, the grinding of said grinding machine being performed in a state that one of the half-toroidal CVT disk and said tool is inclined at a predetermined angle with respect to the other;

determining a maximum diameter of said tool in the range of 0.9 times to 0.5 times an interference grindstone diameter, said interference grindstone diameter being calculated from a dimension between a center of curvature of a curved surface of said traction surface of the half-toroidal CVT disk and a rotation center of said half-toroidal CVT disk, a dimension of the radius of curvature of said traction surface, a dimension of the outer peripheral diameter of said traction surface, and a swing angle, which is an angle to be formed by a rotation axis of said tool with respect to a surface perpendicular to an axis of said half-toroidal CVT disk; and setting said swing angle so that an angle difference between a cutting angle, which is an angle to be formed by a cutting direction of said tool with respect to the axis of the half-toroidal CVT disk, and said swing angle is 15° or less by absolute angle.

10. A method according to claim 9, wherein said swing angle is set to be equal to the cutting angle, and to be in the range of 15°–40°.

* * * * *